US005518122A

United States Patent [19]

Tilles et al.

[11] Patent Number: 5,518,122

[45] Date of Patent: *May 21, 1996

[54] MODULAR MAIL PROCESSING METHOD AND CONTROL SYSTEM

[75] Inventors: David J. Tilles, Woodstock; Francisco J. San Miguel, Catonsville; Thomas F. Grapes, Columbia, all of Md.; Diane L. Deemer, Palatine, Ill.; Stanley K. Wakamiya, Ellicott City, Md.; James D. Mullennix, Crofton, Md.; Mark W. Westerdale, Millersville, Md.; David Bialik, Towson, Md.

[73] Assignee: Westinghouse Electric Corp., Pittsburgh, Pa.

[ * ] Notice: The term of this patent shall not extend beyond the expiration date of Pat. No. 5,363,967.

[21] Appl. No.: 290,506

[22] Filed: Aug. 16, 1994

Related U.S. Application Data

[63] Continuation-in-part of Ser. No. 126,137, Sep. 23, 1993, Pat. No. 5,363,967, which is a continuation of Ser. No. 742,751, Aug. 9, 1991, abandoned.

[51] Int. Cl.[6] ..... B07C 5/00

[52] U.S. Cl. ..... 209/539; 209/546; 209/584; 209/900; 198/464.4

[58] Field of Search ..... 209/584, 539, 209/546, 551, 900, 566, 555, 556, 603, 604, 601, 586; 198/460, 464.4, 502.2; 271/202, 263, 270, 259, 260

[56] References Cited

U.S. PATENT DOCUMENTS

| | | | |
|---|---|---|---|
| 3,757,939 | 9/1973 | Henig | 209/900 X |
| 3,791,515 | 2/1974 | Wood | 209/900 X |
| 3,815,897 | 6/1974 | Hoehl et al. | 271/9 |
| 3,889,811 | 6/1975 | Yoshimura | 209/900 X |
| 3,904,516 | 9/1975 | Chiba et al. | 209/566 |
| 4,106,636 | 8/1978 | Ouimet et al. | 104/88 |
| 4,172,525 | 10/1979 | Hams et al. | 209/900 X |
| 4,247,008 | 1/1981 | Dobbs | 209/569 X |
| 4,331,328 | 5/1982 | Fasig | 271/270 |
| 4,432,458 | 2/1984 | Daboub | 209/900 X |
| 4,494,655 | 1/1985 | Horu et al. | 209/900 X |
| 4,632,252 | 12/1986 | Haruki et al. | 209/584 X |
| 4,634,111 | 1/1987 | Frank | 271/34 |
| 4,640,408 | 2/1987 | Eaves | 198/460 |
| 4,687,106 | 8/1987 | Prins | 209/900 X |
| 4,757,189 | 7/1988 | Daboub | 235/462 |
| 4,877,953 | 12/1989 | Greub | 414/331 |
| 4,884,796 | 12/1989 | Daboub | 271/111 |
| 5,009,321 | 4/1991 | Keough | 209/900 X |
| 5,014,975 | 5/1991 | Hamricke | 271/202 |
| 5,042,667 | 8/1991 | Keough | 209/900 X |
| 5,048,694 | 9/1991 | Iwamoto | 209/900 X |
| 5,105,363 | 4/1992 | Dragon et al. | 271/270 |
| 5,363,967 | 11/1994 | Tilles et al. | 209/539 |

FOREIGN PATENT DOCUMENTS

| | | | |
|---|---|---|---|
| 2255966 | 12/1973 | France | 209/584 |

*Primary Examiner*—David H. Bollinger
*Attorney, Agent, or Firm*—C. O. Edwards

[57] ABSTRACT

A modular mail processing method and control system for sorting pieces of incoming, internal, and outgoing mail including a plurality of sorting bins which correspond to either mail stops or zip codes depending on which sort plan is selected. The modular mail processing method and control system permitting mixed pieces of mail of various sizes to be sorted. Additionally, an internal mail envelope, which has address regions consisting of blocks, may be utilized in connection with the modular mail processing method and control system in order to allow accurate detection of handwritten addresses.

22 Claims, 19 Drawing Sheets

FIG. 7
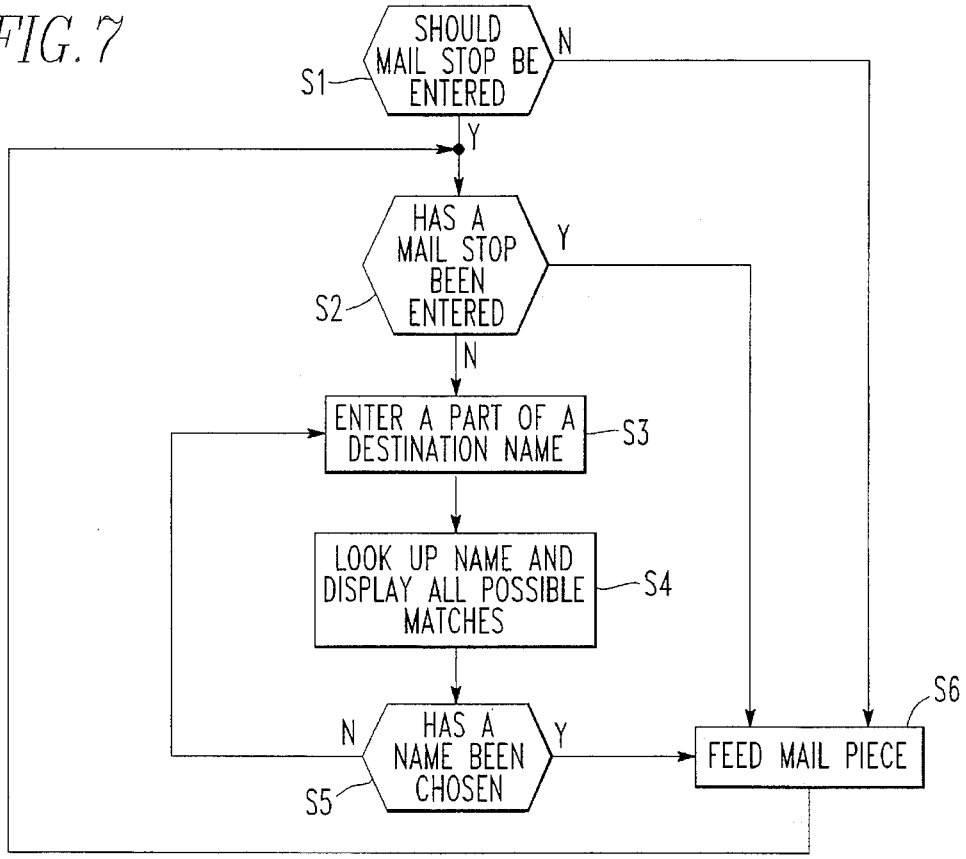
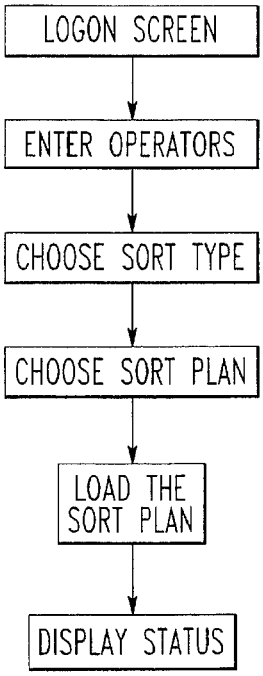
FIG. 10

ENTER MAIL STOP _____ OK | CANCEL | INTERNAL MAIL | AUTOMATIC SORT

DATABASE LOOKUP:
ENTER FIRST NAME, LAST NAME OR BOTH:

THE NAMES THAT MATCHED ARE:

NAME MAIL STOP

1) _____ _____

2) _____ _____

3) _____ _____

ETC.

CHOOSE: _____

FIG. 8

FIG. 11A
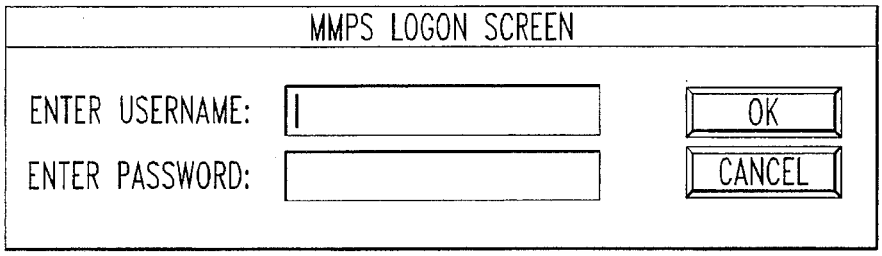
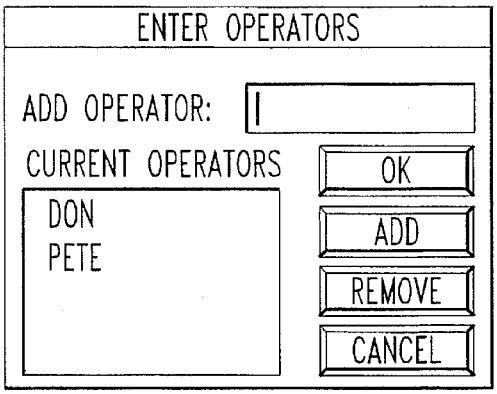
FIG. 11B
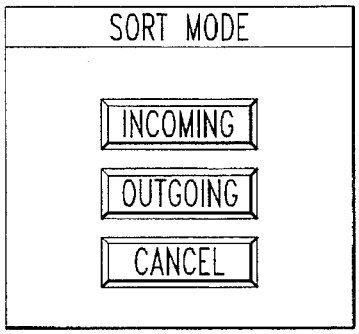
FIG. 11C
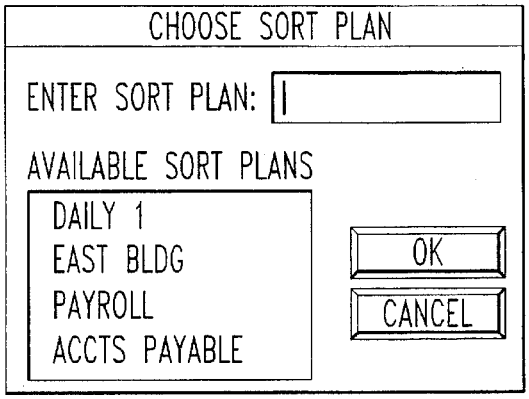
FIG. 11D

| | | | JAMS: | PCS. | % | REJECTS: | PCS. | % |
|---|---|---|---|---|---|---|---|---|
| MACHINE ID: | 55 | | AUTO FEEDER: | 0 | 0 | SORT PLAN: | 0 | 0 |
| RUN ID: | 02 | | MANUAL FEEDER: | 0 | 0 | MISREADS: | 0 | 0 |
| SORT PLAN: | 05 | | MERGE 1: | 0 | 0 | TOTAL: | 0 | 0 |
| TOTAL PIECES: | 10225 | | MLICR: | 0 | 0 | | | |
| | | | INSERTER: | 0 | 0 | | | |
| | | | TOTAL: | 0 | 0 | | | |

BIN STATUS

DISTRIBUTION

FIG. 16
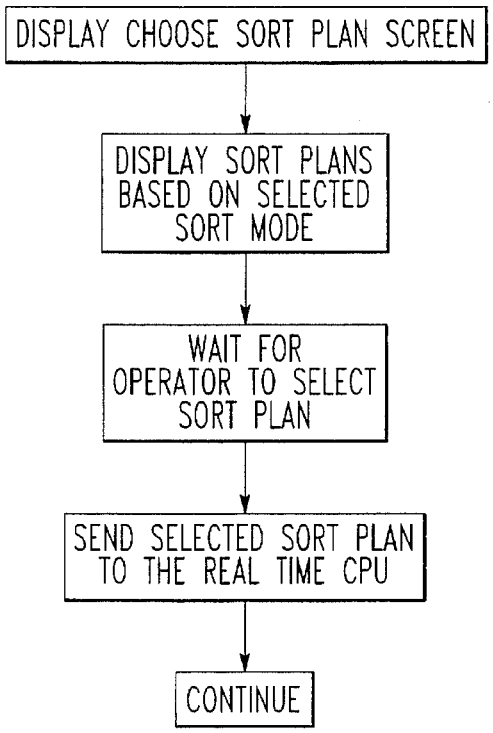
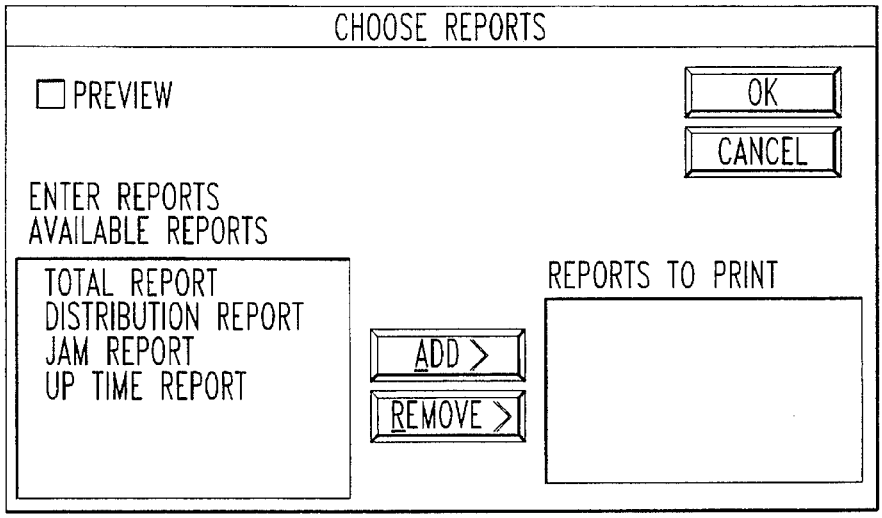
FIG. 17

PASSWORD TABLE

| NAME | SIZE/FORMAT | DESCRIPTION |
|---|---|---|
| PASSWORD | CHAR* | ENCRYPTED WITH ARBITRARY DATE/TIME |
| UNIQUE ID | LONG | |
| LAST NAME | CHAR[30] | |
| FIRST NAME | CHAR[15] | |
| OPTIONAL INFORMATION | *CHAR | VARIABLE LENGTH |

MASTER SORT PLANS TABLE

| NAME | SIZE/FORMAT | DESCRIPTION |
|---|---|---|
| SORT PLAN ID | SHORT | UNIQUE ID |
| SORT PLAN NAME | CHAR[30] | WHAT YOU CALL IT |
| DESCRIPTION | CHAR[30] | OPTIONAL DESCRIPTION |

SORT PLANS LIST TABLE

| NAME | SIZE/FORMAT | DESCRIPTION |
|---|---|---|
| SORT PLAN ID | SHORT | KEY: WHICH SORT PLAN DOES THIS RECORD BELONG TO |
| DESTINATION RANGE | SHORT[2] | MAIL STOP OR ZIP+4, RANGE (EXAMPLE: 21046 THROUGH 21055; MS 6164 THROUGH 6128) |
| BIN NUMBER | SHORT | THESE PIECES GO TO THIS BIN |
| PASS NUMBER | SHORT | USE THIS RECORD ONLY DURING THIS PASS NUMBER (FIRST PASS, SECOND PASS, ETC.) |

*FIG. 21 A*

PHONE/MS DIRECTORY TABLE

| NAME | SIZE/FORMAT | DESCRIPTION |
|---|---|---|
| LAST NAME | CHAR[30] | |
| FIRST NAME | CHAR[15] | |
| MAIL STOP | *CHAR | VARIABLE LENGTH |
| PHONE | *CHAR | VARIABLE LENGTH |

MASTER MANIFESTS TABLE

| NAME | SIZE/FORMAT | DESCRIPTION |
|---|---|---|
| MANIFEST NUMBER | LONG | INDEX TO MANIFEST |
| DATE PREPARED | CHAR[13] | MANIFEST DATE |
| ESTIMATED MAILING DATE | CHAR[13] | MANIFEST DATE |
| PERMIT NUMBER | LONG | USPS PERMIT IMPRINT # |

MANIFEST LIST

| NAME | SIZE/FORMAT | DESCRIPTION |
|---|---|---|
| MANIFEST NUMBER | LONG | INDEX TO MANIFEST |
| ZIP | SHORT | 5 DIGIT ZIP |
| +4 | SHORT | |
| CARRIER ROUTE | SHORT | |
| BATCH SERIAL NUM RANGE | SHORT | |
| NUM PIECES | SHORT | |
| BATCH POSTAGE | SHORT | |

REPORTS

RUN TABLE

| NAME | SIZE/FORMAT | DESCRIPTION |
|---|---|---|
| MACHINE ID/RUN ID | LONG | KEY FIELD: THE UNIQUE ID FOR ALL FIELDS IN A REPORT |
| SORTPLAN | LONG | |
| OPERATORS | LONG[10] | MAX 10 OPERATORS PER RUN |
| START TIME | DATE/TIME | |
| STOP TIME | DATE/TIME | |
| TOTAL NUM PCS | LONG | |

TIMELINE TABLE

| NAME | SIZE/FORMAT | DESCRIPTION |
|---|---|---|
| MACHINE ID/RUN ID | LONG | KEY TO THE RUN TABLE |
| EVENT ID | LONG | UNIQUE ID OF THIS EVENT |
| SIGNIFICANT EVENT | SHORT | WHAT IS HAPPENING: START SORT, STOP SORT, JAM, MAINTENANCE, SETUP, IDLE, E-STOP, ... |
| TIME | DATE/TIME | WHEN DID THE MACHINE CHANGE TO THIS STATE |
| DURATION | TIME | HOW LONG WAS THE MACHINE IN THIS STATE. THIS IS UPDATED WHEN THE NEXT TIMELINE EVENT IS ADDED! |

REJECTS TABLE

| NAME | SIZE/FORMAT | DESCRIPTION |
|---|---|---|
| MACHINE ID/RUN ID | LONG | KEY TO THE RUN TABLE |
| LETTER ID | LONG | KEY TO THE LETTER LIST TABLE |
| REJECT CAUSE | SHORT | MISREAD FBCR, MISREAD MLICR, NO ZIP, OUT OF SORTPLAN, TOO SMALL, TOO TALL, TOO LONG, ... |

*FIG. 21 B*

JAM TABLE

| NAME | SIZE/FORMAT | DESCRIPTION |
|---|---|---|
| MACHINE RD/RUN ID | LONG | KEY TO THE RUN TABLE |
| LOCATION | SHORT | WHERE ON THE MACHINE |
| CAUSE | SHORT | ANY POSSIBLE INFERENCE, BESIDES LOCATION |
| NUMBER OF PIECES INVOLVED | SHORT | NUMBER OF PIECES INVOLVED IN THE CRASH |
| LETTER ID | LONG | KEY TO AN ENTRY ON THE LETTER LIST TABLE OF THE OFFENDING LETTER |
| EVENT ID | LONG | KEY TO THE TIMELINE TABLE |

STACKER TABLE

| NAME | SIZE/FORMAT | DESCRIPTION |
|---|---|---|
| MACHINE ID/RUN ID | LONG | KEY TO THE RUN TABLE |
| BIN NUMBER | SHORT | |
| NUMBER OF SWAPS THIS RUN | SHORT | |
| TOTAL PIECES | SHORT | |
| TOTAL WEIGHT | SHORT | 10THS OF AN OZ |
| AVG WEIGHT | SHORT | 10THS OF AN OZ |
| STD DEV WEIGHT | SHORT | 10THS OF AN OZ |
| TOTAL THICKNESS | SHORT | 100THS OF AN INCH |
| AVG THICKNESS | SHORT | 100THS OF AN INCH |
| STD DEV THICKNESS | SHORT | 100THS OF AN INCH |

LETTER LIST

| NAME | SIZE/FORMAT | DESCRIPTION |
|---|---|---|
| MACHINE ID/RUN ID | LONG | KEY TO THE RUN TABLE |
| LETTER ID | SHORT | LETTER UNIQUE ID |
| FED BY | SHORT | WHICH STATION FED IT |
| WEIGHT | SHORT | IN 10THS OF AN OZ |
| KEYED VALUE | LONG | IN MANUALLY ENCODED |
| OCR VALUE | LONG | IF READ BY MLICR |
| FBCR VALUE | LONG | IF READ BY FBCR |
| VERIFY VALUE | LONG | IF VERIFIED |
| THICKNESS | SHORT | |
| WIDTH | SHORT | |
| HEIGHT | SHORT | |
| BIN DESTINATION | SHORT | WHICH BIN IT WENT TO |
| CARRIER NUMBER | | |

*FIG. 21 C*

MODULAR MAIL PROCESSING METHOD AND CONTROL SYSTEM

CROSS REFERENCE TO RELATED APPLICATIONS

This application is a continuation-in-part application of U.S. patent application Ser. No. 126,137, filed on Sep. 23, 1993, now U.S. Pat. No. 5,363,967, the content of which is relied upon and incorporated by reference herein, which, in turn, is a continuation application of U.S. patent application Ser. No. 07/742,751, filed on Aug. 9, 1991, now abandoned.

BACKGROUND OF THE INVENTION

1. Field of the Invention

The present invention relates to a mail processing system; and in particular, to a modular mail processing method and control system for sorting incoming, outgoing, and internal mail.

2. Discussion of the Related Art

Traditionally, mail processing systems are custom systems designed for a particular customer's needs. These systems are typically designed for high volume installations such as those that sort 30,000 to 40,000 pieces of mail per hour. With such large installations, custom designs to process either outgoing mail or internal mail are economically feasible. In these designs, the mail processing machinery and associated control system are fixed designs for the installation and are not easily modified for either future requirements or for the needs of other installations. Such custom designs are not economically practical for smaller installations that process in the range of 20,000 to 100,000 pieces of mail per day. Thus, there exists a demand for a low cost, flexible processing system that can be inexpensively and quickly reconfigured to meet the needs of such low volume installations.

Additionally, corporate and institutional mail rooms, which primarily constitute these smaller installations, typically maintain large staffs for handling the mail that must be processed daily. The type of mail processed by the typical corporate or institutional mail room includes internal mail, which originates within the organization and has a destination also within the organization, incoming mail, which comes into the organization from external sources, and outgoing mail, which originates within the organization and has a destination external to the organization. Moreover, in the typical corporate or institutional mail room, 60% of the daily mail is internal, 35% is incoming, and 5% is outgoing. Therefore, in order to be practical, mail processing systems for these smaller installations should be capable of sorting the organization's internal and incoming mail into bins corresponding to internal mail stops as well as sorting the organization's outgoing mail.

SUMMARY OF THE INVENTION

Accordingly, the present invention has been made in view of the above circumstances and has as an object to provide a low cost, flexible, modular mail processing method for sorting internal, incoming, and outgoing mail.

It is another object of the present invention to provide a low cost, flexible, modular mail processing control system for sorting internal, incoming, and outgoing mail.

It is yet another object of the present invention to provide a modular mail processing method and control system capable of reading handwritten addresses on internal office envelopes.

It is still another object of the present invention to provide a modular mail processing method and control system capable of performing real time address correction for improperly addressed pieces of internal, incoming, and outgoing mail.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings.

To achieve the above and other objects, the present invention provides a method of processing pieces of internal mail received from an internal source in a system including a stacker module having a number of carriers and bins, a plurality of serially connected induction transfer modules, including a feeder module, that are positioned to transport the pieces of internal mail from the feeder module to the stacker module, the method comprising the steps of: (a) monitoring the position of each carrier; (b) pre-selecting an empty carrier; (c) feeding a piece of internal mail from the feeder module to another induction transfer module at a desired time based on the position of the pre-selected carrier; (d) tracking the position of the piece of internal mail through the induction transfer modules; (e) obtaining address information from the piece of internal mail, wherein the address information includes a mail stop; (f) selecting a bin for the piece of internal mail based on the address information, the selected bin corresponding to a mail stop; (g) transferring the piece of internal mail from a last induction transfer module to the pre-selected carrier; and (h) diverting the piece of internal mail from the selected carrier to the selected bin.

The present invention also provides a method of processing pieces of incoming mail received from an external source in a system including a stacker module having a number of carriers and bins, a plurality of serially connected induction transfer modules, including a feeder module, that are positioned to transport the pieces of incoming mail from the feeder module to the stacker module, the method comprising the steps of: (a) monitoring the position of each carrier; (b) pre-selecting an empty carrier; (c) feeding a piece of incoming mail from the feeder module to another induction transfer module at a desired time based on the position of the pre-selected carrier; (d) tracking the position of the piece of incoming mail through the induction transfer modules; (e) obtaining address information from the piece of incoming mail, wherein the address information includes an addressee's name; (f) selecting a bin for the piece of incoming mail based on the address information, the selected bin corresponding to a mail stop; (g) transferring the piece of incoming mail from a last induction transfer module to the pre-selected carrier; and (h) diverting the piece of incoming mail from the selected carrier to the selected bin.

The present invention further provides a modular mail processing control system for controlling the flow of mail through a series of induction transfer modules to a stacker/transport module that includes a number of carriers and bins, the system comprising: feeder means, located in one of the induction transfer modules, for injecting a piece of mail into another induction transfer module at a desired time based on a pre-selected carrier being at a given position, and for identifying the piece of mail; encoder means, located in one of the induction transfer modules, for obtaining address information from the piece of mail and for identifying a bin for the piece of mail, wherein the address information includes a mail stop, and the bins correspond to mail stops; tracking means, located in each of the induction transfer modules, for tracking the position of the piece of mail as it moves through the induction transfer modules, and in response to a position error stopping the series of induction transfer modules, storing the identification of at least the piece of mail involved in the position error and storing the position of the induction transfer modules of the stacker/transport module; inserter means, located in one of the induction transfer modules for inserting the piece of mail into the pre-selected carrier when the pre-selected carrier arrives at a desired location; and means for diverting the piece of mail from the carrier to the identified bin.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification illustrate several embodiments of the invention and, together with the description, serve to explain the objects, advantages, and principles of the invention. In the drawings.

FIG. 7 is a flow diagram of the manual feed terminal interface real time software module;

FIG. 8 illustrates the display at the system console during the manual feed process;

FIG. 10 is a logic flow diagram of the process performed to enable the system to perform a sort;

FIGS. 11A–11D illustrate the display at the system console during the FIG. 10 process;

FIG. 16 is a logic flow diagram for the Choose Sort Plan processing shown in FIG. 10;

FIG. 17 illustrates a display as the non real time CPU 275 that occurs when an operator selects the reports option shown in FIG. 4;

FIGS. 21A–21C provide an example of the type of information maintained by the non real time CPU 275.

DETAILED DESCRIPTION OF THE PREFERRED EMBODIMENTS

Reference will now be made in detail to the present preferred embodiments of the invention, examples of which are illustrated in the accompanying drawings.

As used herein, the term "piece(s) of mail" is intended to broadly include pieces of internal, incoming, and outgoing mail. It will be understood that the mechanics of sorting these different types of mail are similar with the general exception that different portions of the address listed on the pieces of mail are used to sort the mail. For example, the zip code, state, and city portions of an address are typically used to sort outgoing mail, while an addressee's name and mail stop portions of an address are used to sort incoming and internal mail.

The majority of pieces of internal mail typically consist of interoffice flats envelopes 13×10 inches and less than one inch thick. These interoffice envelopes include a plurality of lines for writing a destination address. Users of the envelopes normally cross out a previously written address and handwrite the destination address on the next line. The envelope is then delivered to the first address not crossed out.

To facilitate sorting of internal mail, uniquely designed interoffice mail envelopes may be distributed for use in sending internal mail. Two examples of such interoffice mail envelopes 400 and 500 are shown in FIGS. 22 and 23.

Figure 22:
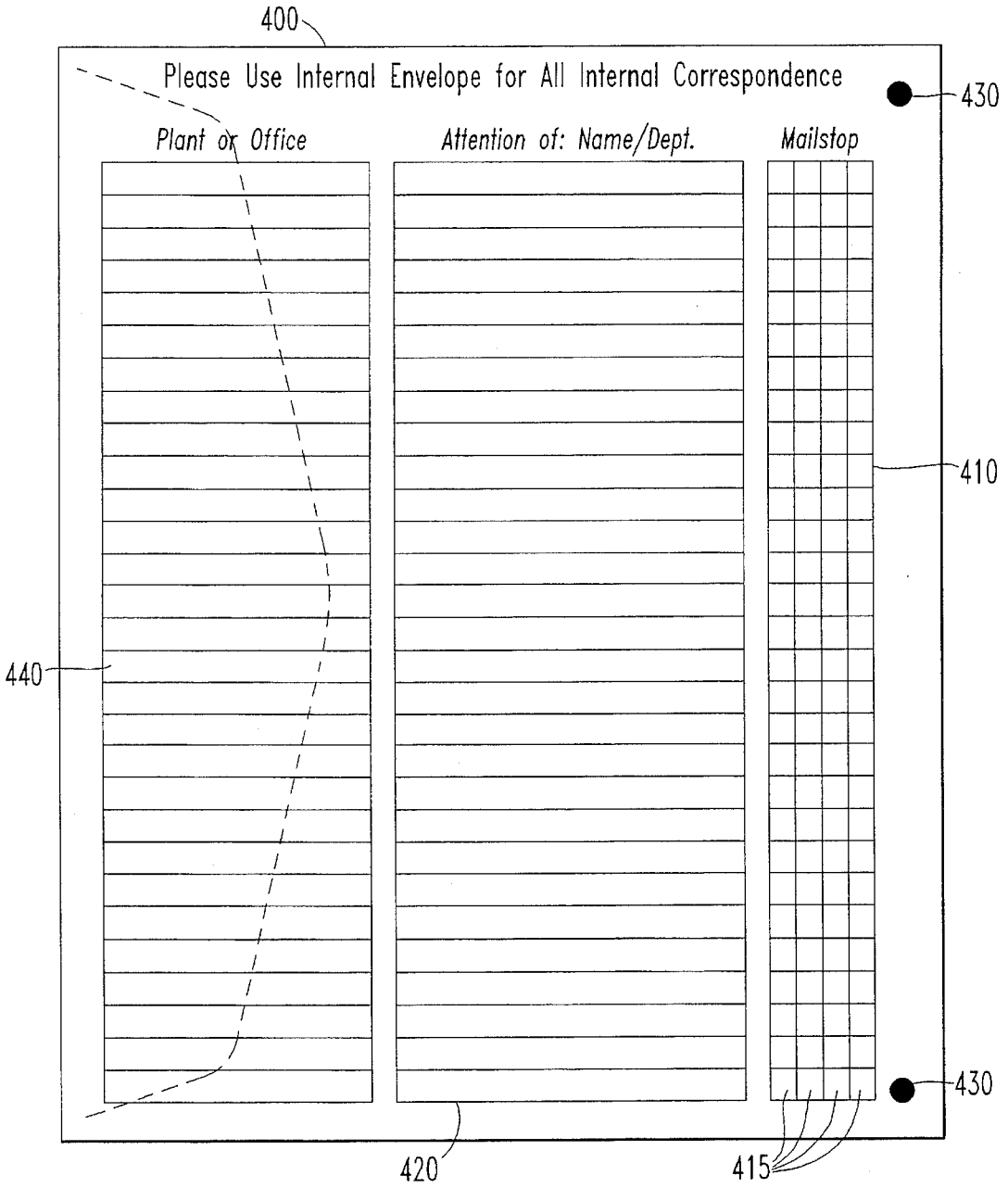
FIG. 22 is a graphic representation of an internal mail envelope according to one embodiment of the present invention.

Envelope 400, shown in FIG. 22, is similar to conventional interoffice mail envelopes with the exception that the region 410 designated for writing the destination mail stop is formed of a plurality of blocks 415. Persons using envelope 400 preferably write one character of the destination mail stop per block 415. Envelope 400 further includes an address region 420 for writing an addressee's name.

Figure 23:
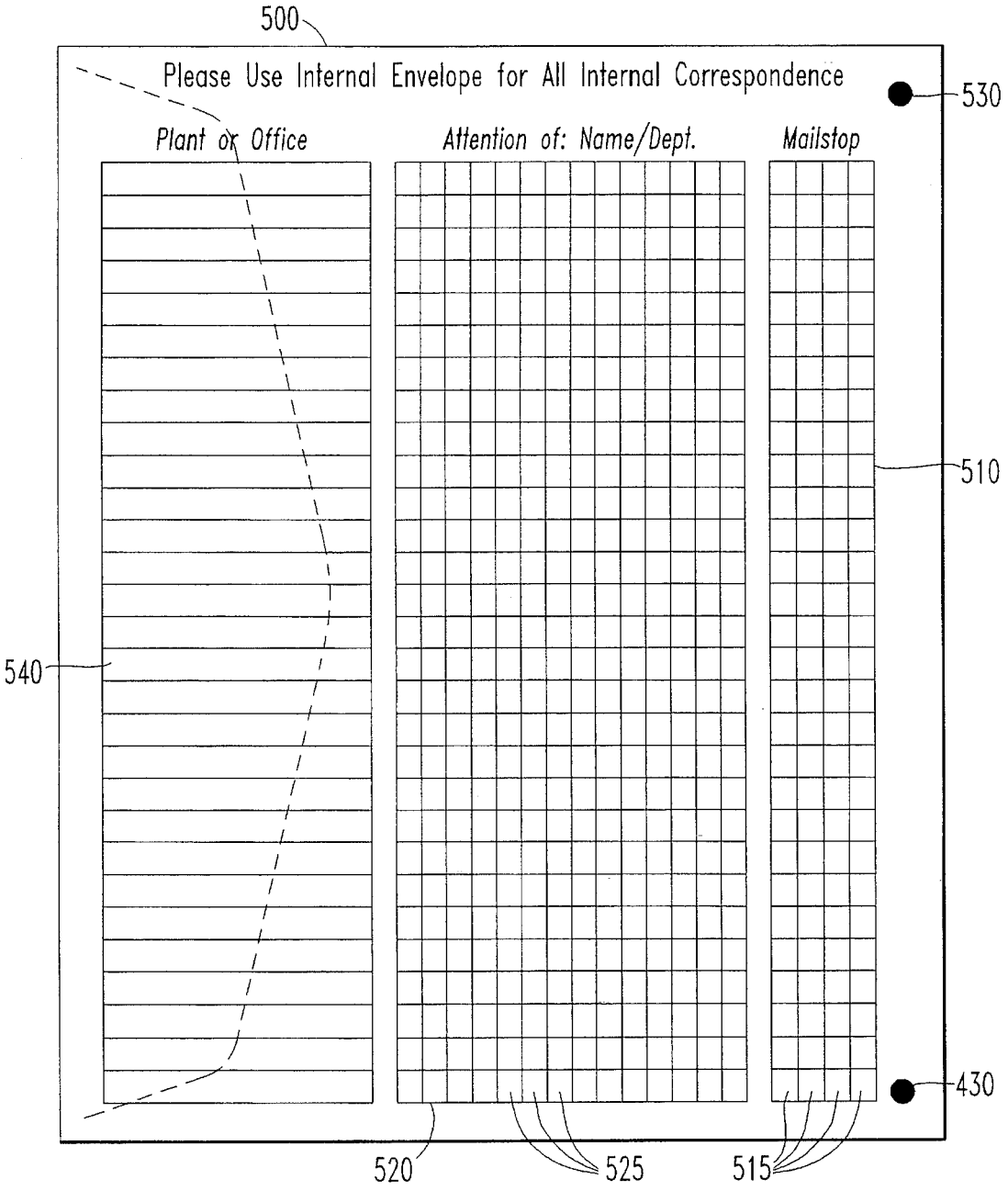
FIG. 23 is a graphic representation of an internal mail envelope according to another embodiment of the present invention.

Envelope 500, shown in FIG. 23, differs from that shown in FIG. 22 in that the region 520 designated for writing the addressee's name is also formed of a plurality of blocks 525. Persons using envelope 500 preferably write one character of the addressee's name per block 525. Like envelope 400, envelope 500 further includes an address region 510 including a plurality of blocks 515 for writing a mail stop.

By providing the blocks 415, 515, and 525, the mail sorter can more readily distinguish the handwritten characters representing the destination name and mail stop. Thus, by using envelopes encompassing the concepts of those shown in FIGS. 22 and 23, the mail sorter may sort internal mail more accurately and with less human intervention.

Envelopes 400 and 500 offer the additional advantage that users may cross out a previously written address and handwrite the destination address on the next line in the same manner as conventionally performed. Thus, it is not necessary that users utilize preprinted address labels.

Envelopes 400 and 500 additionally may include unique marks 430 and 530, respectively, to identify the envelope as an internal mail envelope. Upon reading one of these marks 430 and 530, the mail processing system of the present invention searches for the first mail stop that has not been crossed out, and performs character recognition on the handwritten characters of the mail stop. Subsequently, the mail processing system of the present invention performs a context correlation to verify that the mail stop is a valid mail stop. Additionally, the mail processing system may search for the first addressee name that has not been crossed out, and perform character recognition on the handwritten characters of the name. Again, the mail processing system performs a context correlation to verify that the written name is a valid name. By performing correlations on both the mail stop and the addressee's name, the mail processing system may sort the piece of internal mail more accurately.

Additionally, envelopes 400 and 500 may include address regions 440 and 540, respectively, for writing the plant or office of the addressee. These address regions 440 and 540 may also be provided with a plurality of boxes for processing the information written therein in the same manner as described above with respect to the names and mail stops.

Conventional mail processing systems are designed for sorting external or outgoing mail. Such mail processing systems sort outgoing mail by correlating external addresses (i.e., the street, city, state, and zip code of the address). Therefore, conventional mail processing systems have not correlated addressee names or mail stops in sorting mail. Therefore, the present invention has been designed to include a database in which the names and mail stops of personnel to permit sorting of incoming and internal mail by correlation of addressee names and mail stops. By maintaining an updated database of names and mail stops, an organization employing the present invention, may ensure reliable mail delivery to personnel who frequently relocate or leave the organization.

Incoming mail typically includes pieces of mail that vary considerably in size. Thus, to sort incoming mail, a mail processing system must be capable of sorting pieces of various sizes. The mail processing system of the present invention has this capacity as will be further described below.

In sorting incoming mail, the mail processing system of the present invention, searches the address of a piece of incoming mail for a name that corresponds to a name stored in the database. Upon recognizing the addressee's name, the system identifies the present mail stop of the addressee, and sorts the piece of incoming mail to a bin corresponding to the identified mail stop.

In the event that the addressee's name is identified, but the address is incorrect, as would be the case of an employee who has moved to a different location, the present invention prepares a forwarding label including the proper address of the addressee and sorts the piece of mail to an appropriate bin for forwarding mail.

When an employee's address changes, the database may be updated to include the new address without erasing the old address. The old address may be then be used to ensure proper correlation and identification of the employee.

When used to sort outgoing mail, the modular mail processing system of the present invention preferably assigns zip codes to its sorting bins and sorts the outgoing mail based on zip codes when an outgoing mail sort plan is selected. On the other hand, when an incoming or internal sort plan is selected, the modular mail processing system preferably assigns mail stops to its sorting bins and sorts the incoming or internal mail based on mail stops. Thus, by selecting the appropriate sort plan, one may properly sort incoming, internal, or external mail.

A detailed description of the mail processing system of the present invention will now be described.

Figure 1:
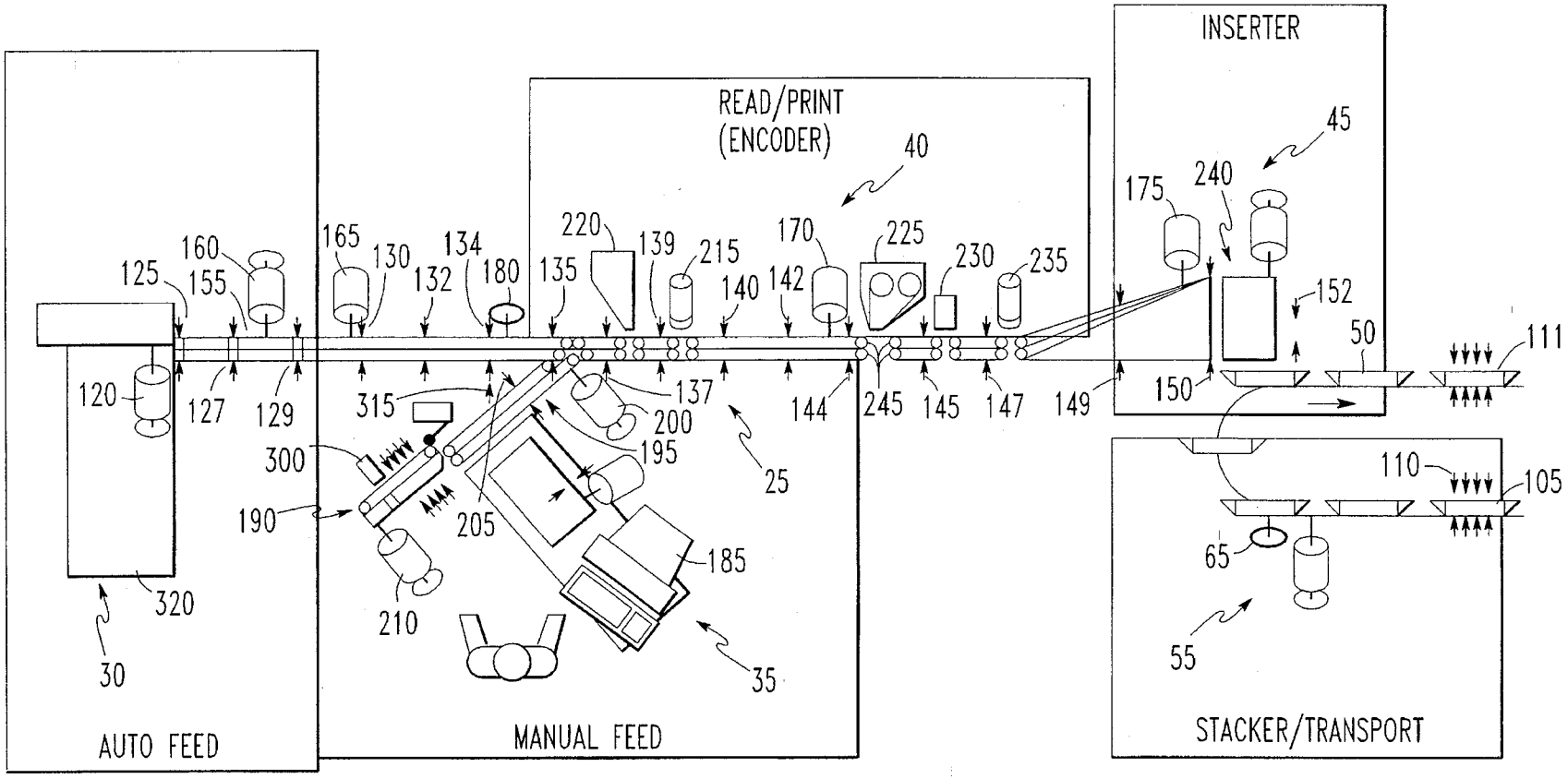
FIG. 1 is a schematic diagram of an induction transfer portion of a mail processing system in accordance with the present invention.

FIG. 1 is a schematic diagram of an induction transfer portion of a mail processing system in accordance with the present invention. In FIG. 1, reference numeral 20 identifies induction transport modules. As shown in FIG. 1, the induction transport modules are connected in series to form an induction transfer line 25 in FIG. 1, reference numeral 30 identifies an automatic feeder induction transfer module, reference numeral 35 identifies a manual feeder induction transport module, reference numeral 40 identifies an encoder induction transport module. The encoder induction transport module 40 feeds pieces of mail to an inserter induction transport module 45 which inserts the pieces of mail into a selected carrier 50 of a stacker/transport module 55.

Figure 2:
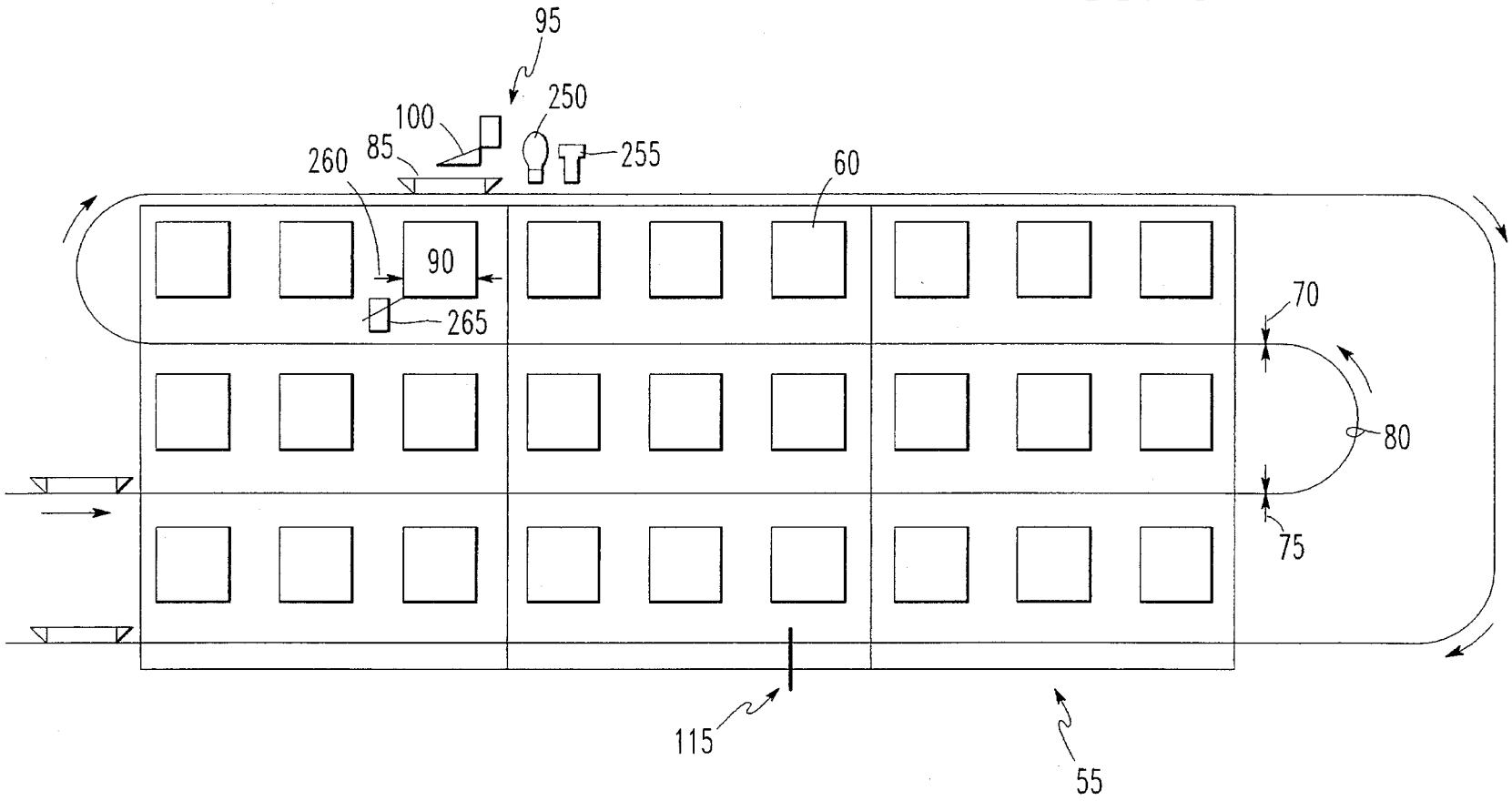
FIG. 2 is a schematic diagram of a stacker/transport module in accordance with the present invention.

FIG. 2 is a schematic diagram of a stacker/transport module in accordance with the present invention. The stacker/transport module 55 shown in FIG. 2 includes a number of bins 60. Referring to FIG. 1, an encoder 65 provides pulses to a control system (FIG. 3) identifying the location of carriers such as the carrier 50 within the stacker/transport module 55. The control system shown in FIG. 3 monitors the position of each carrier based on a number of pulses generated after the carrier is sent by a carrier number 1 sensor as shown in FIG. 2. Also shown in FIG. 2 is a chain stretch sensor 75. This sensor senses the amount of flex in a chain 80. A drive sprocket (not shown) can then be adjusted to take up the slack in the chain 80.

Referring to FIG. 2, when a carrier 85 reaches a selected bin 90, a diverter 95 is activated to move a rake 100 so as to engage the carrier 85; thus, deflecting the mail in the carrier 85 into the selected bin 90.

Figure 3:
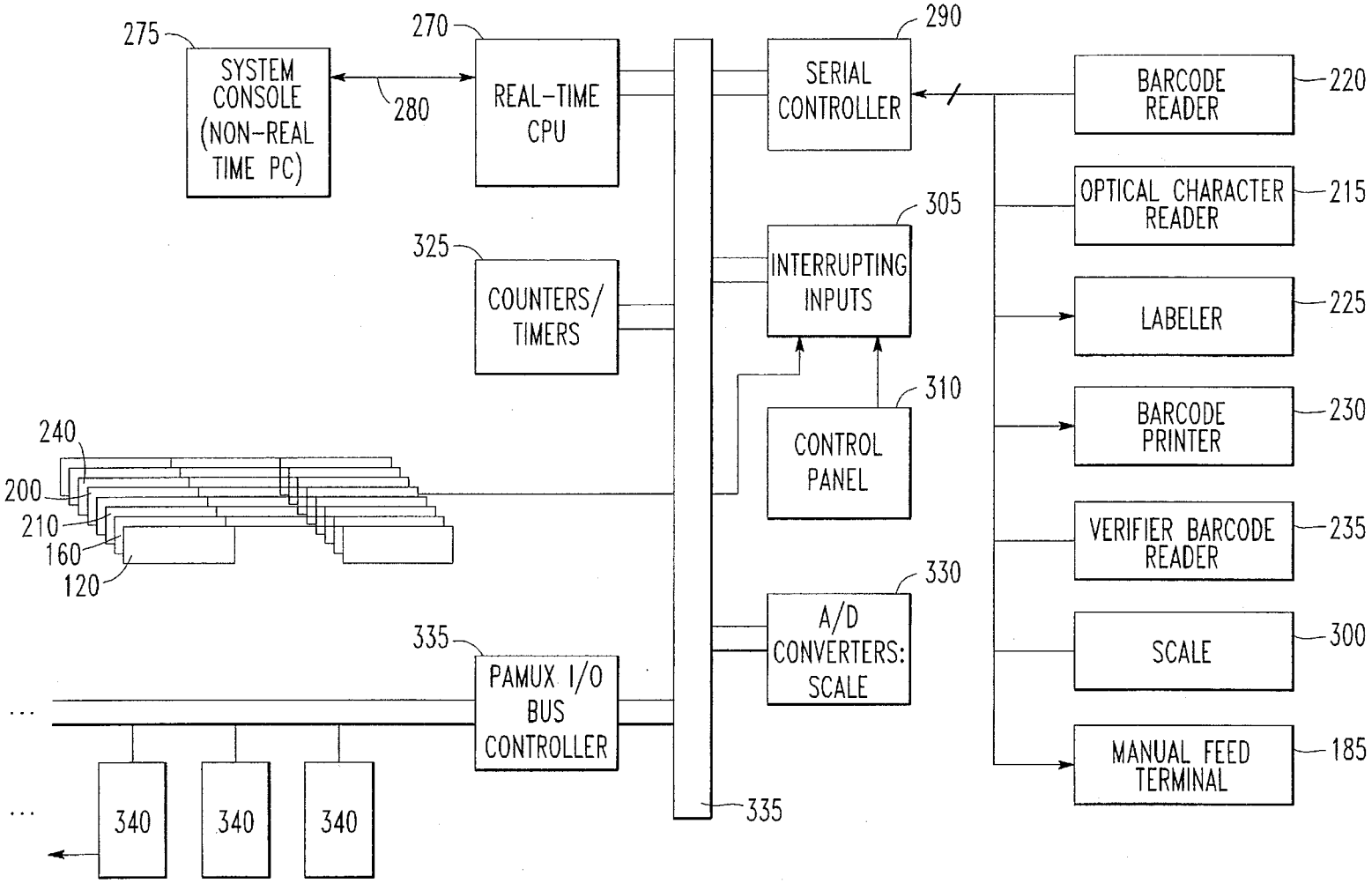
FIG. 3 is a schematic diagram of a modular mail processing control system embodying the present invention.

The control system shown in FIG. 3 controls the modular mail processing system shown in FIG. 1 so that a piece of mail injected into the induction transfer line by either the automatic feeder 30 or the manual feeder 35 reaches the selected carrier 50 when the selected carrier 50 is positioned to receive a piece a mail from the inserter induction transfer module 45. In a preferred embodiment of the present invention, the induction transfer line 25 operates at approximately 75 inches per second. The controller shown in FIG. 3 maintains the status of each carrier based on when a carrier is fed with a piece of mail and when a piece of mail is diverted out of a carrier. The FIG. 3 controller therefore selects an empty carrier based on this maintained status. The carrier empty sensor 110 and the carrier full sensors are used by the FIG. 3 controller to detect errors when the maintained status differs from the detected status of a carrier. The control system shown in FIG. 3 determines the distance of the empty carrier 105 from an arbitrary starting line 115 shown FIG. 2. The position of the starting line 115 is selected so that a carrier will arrive at the location adjacent the inserter module 45 in a position to receive a piece of mail from the inserter module 45 given a nominal rate of flow of a piece of mail through the induction transfer line 25. Thus, for example if the induction transfer line 25 is operating at the same rate as the carrier (75 inches per second) and the length of the induction transfer line from, for example, the output of the auto feeder 30 to the output of the inserter module 45 is 25 feet, then the starting line 115 is positioned 25 feet from the point at which the selected carrier 50 arrives at a position with respect to the inserter module 45 to receive mail from the insert module 45. In such a case, when an empty carrier 105 reaches the starting line 115, then the control system shown in FIG. 3 would feed a piece of mail, via the auto feeder 30, to the induction transfer line 25. There is, of course, a different starting line for the manual feeder 35. Since the manual feeder 35 is closer to the desired position of the empty tray 105 adjacent the inserter module 45, the starting line for the manual feeder 35 would be closer to the inserter 45 than the starting line 115. Functionally, when an empty carrier reaches a starting line, the controller shown in FIG. 3 checks to see if there is a piece of mail to be fed by either the manual feeder 35 or the auto feeder 30. If there is a piece of mail to be fed into the induction transfer line 25, the FIG. 3 control system starts the appropriate servo motor at either the auto feeder 30 or the manual feeder 35. For example, if an empty carrier is at the starting line 115, and the auto feeder 30 has a piece of mail to insert into the induction transfer line 25, the FIG. 3 controller starts the servo motor 120 to feed a piece of mail into the induction transfer line 25. When a piece of mail is fed into the induction transfer line 25, the FIG. 3 controller stores an identification of the piece of mail together with the thickness of the piece of mail. FIG. 3 controller may also store the weight of the piece of mail with the identification of the piece of mail. A series of sensors 125–152 are located amongst the induction transport modules 20. The sensors detect the presence of a piece of mail, and comprise, for example, through beam type sensors. Each piece of mail inserted into the induction transfer line 25 is individually identified by the FIG. 3 controller and tracked through the induction line 25. For example, when the auto feeder 30 is instructed by the FIG. 3 controller to insert a piece of mail, the leading edge of the piece of mail is detected by the sensor 125. If the piece of mail is traveling normally, then the FIG. 3 controller detects the trailing edge of the piece of mail passing the sensor 125. If the sensor 125 detects another piece of mail before the trailing edge of the current piece of mail leaves sensor 127, then a position error or jam situation exists.

As a preferred alternative, when sensor 125 detects the piece of mail, FIG. 3 controller calculates an arrival time at inserter module 45. If the piece of mail is going to arrive too late, then there is a jam. To perform this function, FIG. 3 controller calculates actual position and desired position and compares the two. If the difference exceeds a predefined threshold, a jam is deemed to exist. In the present invention, the predefined threshold may be adjusted to account for the types of mail the user typically sorts. Preferably, this predefined threshold is set at ±3 inches.

When a jam occurs, the FIG. 3 controller stores the identification of the current piece of mail as well as the other piece of mail and begins to shut down the induction transport modules 25 and the stacker/transport module 55. The FIG. 3 controller stops feeding mail to the transfer line 25. The FIG. 3 controller then stops all motors, and determines in which module the position error occurred. The motors at this point are slowing down towards a stop. The FIG. 3 controller informs the operator of the jam and its location via the system console. The operator then removes the pieces of mail that need to be removed, and presses a system start button. In response to the system start button being pressed, the FIG. 3 controller turns all of the motors back on at a slow speed and waits until all of the mail is out of the induction transfer line 25 and into the appropriate carriers. At this point, the FIG. 3 controller turns all of the motors onto their normal speed and begins feeding mail normally.

The portion of the induction transfer line between the sensors 127 and 129 is an optional catch-up section 155. In this section, the FIG. 3 controller can adjust the position of the piece of mail based on the amount of movement that the selected carrier has undergone. In other words, the piece of mail in the catch-up section 155 has a desired position and an actual position with respect to the position of the carrier determined based on the output of encoder 65. The FIG. 3 controller can either accelerate or decelerate the piece of mail so that its position coincides with the desired position for the piece of mail. Referring to FIG. 1, when a piece of mail reaches the sensor 127, the FIG. 3 controller determines if a correction is necessary, and if so, how much. Once the trailing edge of the piece of mail is detected by the sensor 127, the FIG. 3 controller actuates a first catch-up servo motor 160. The movement of the piece of mail is thus accelerated or decelerated so that its position coincides with a desired position based on the position of the selected carrier within the stacker/transport module 55. When the leading edge of the piece of mail reaches the sensor 129, the position adjustment stops, and the piece of mail continues to move along the induction transfer line at its nominal rate (e.g., 75 inches per second). The induction transfer line 25 is driven at its nominal rate by three AC synchronous motors 165, 170 and 175 as shown in FIG. 1. Although the present invention is described using three AC synchronous motors, it will be apparent to those of ordinary skill that more or less AC synchronous motors may be utilized depending, in part, upon the number of modules used in the system.

While a piece of mail is between adjacent sensors such as 127 and 129, the FIG. 3 controller monitors for position errors (jams) as described with respect to sensors 125 and 127. Thus, adjacent sensor such as 125 and 127, and 127 and 129 may function as sensor pairs that enable the FIG. 3 controller to track the position of the piece of mail through the induction transfer line 25 and to detect position errors in the induction transfer modules 20.

Again, an alternative method of determining position errors exists wherein the FIG. 3 controller compares actual arrival times with target arrival times and determines that positioning errors exist when the difference exceeds a predefined threshold.

As shown in FIG. 1, an encoder 180 is coupled to the induction transfer line 25. The FIG. 3 controller uses the output of the encoder 180 to determine the position of mail in the induction transfer line 25, or in other words, the position of the induction transfer modules 20. Thus, in the event of a position error detected, as noted above, the FIG. 3 controller determines the position of the induction transfer modules 20. Upon detecting a position error the FIG. 3 controller also determines and stores the position for the stacker/transport module based on the position indicated by the encoder 65. Thus, in the event of a position error the FIG. 3 controller stores the identification of the piece of mail involved in the position together with the position of the induction transport modules 20 and the stacker/transport modules 55. This enables the FIG. 3 controller to stop normal processing of the mail upon detecting a position error, and restart processing of the mail with the induction transport modules 20 and stacker/transport module 55 at their respective positions that existed at the time that the position error was detected.

As shown in FIG. 1, mail pieces can also be injected into the induction transfer line 25 by a manual feeder 35. The manual feeder 35 includes a terminal 185, a cleated belt feed section 190 and a catch-up section 195. The catch-up section 195 includes a servo motor 200 together and with sensor 205 and 135 function in the same manner as the catch-up section 155. The operation of the manual feeder terminal 185 is described in detail below. Functionally, when an operator places a piece of mail in the cleated belt section 190, the FIG. 3 controller determines that the mail is present and determines its thickness. FIG. 3 controller may further determine the weight of the pieces of mail. This information together with an identification of the piece of mail is stored. When the FIG. 3 controller identifies an empty carrier 105 at the starting line for the manual feeder, as noted above, the FIG. 3 controller starts a servo motor 210 that causes the piece of mail to be pushed into the catch-up section 195.

As shown in FIG. 1, the encoder induction transport module includes a number of optional elements. Basically, the encoder induction transport module functions to read address information from the piece of mail and, together with the FIG. 3 controller to identify a bin 90 in the stacker/transport module 55 for the piece of mail. The address information can be detected from the piece of mail by either an optical character reader (OCR) 215 or a bar code reader (BCR) 220. There is, of course, no reason why both of these elements cannot be used in a system. This obviously would increase the cost, but enhance the flexibility of its system. The encoder induction transport module 40 can also include labeler 225, a bar code printer 230 and a verify bar code reading 235. The labeler 225 can be controlled by the FIG. 3 system to print the labels on outgoing mail. The labeler 225 can also be used for address correction. For example, if the OCR 215 reads address information and this address information is incorrect because the destination has been changed, a new label can be printed and applied to the piece of mail by the labeler 225. In addition, pieces of mail traveling through the system can have a bar code printed thereon for future sorting, either at another location or internally. The FIG. 3 control system includes a data base of addresses. This data base can be used to verify the address information read by either the bar code reader 220 or the optical character reader 215. If the destination address has been changed, then as mentioned, the labeler can apply a new label to the piece of mail. In addition, when the bar code reader 220 or the optical character reader 215 reads the address information from the piece of mail, the FIG. 3 controller identifies a bin 60 within the stacker/transport module 55 and stores this with the identification of the piece of mail. Thus, when the piece of mail reaches the selected carrier 50, the stacker/transport module moves the selected carrier 50 while the FIG. 3 system monitors the location of the carriers. When the selected carrier 50 arrives at the appropriate bin 60, the FIG. 3 control system activates the diverter 95 which causes a rake 100 to push the piece of mail out of the selected carrier and into the selected bin 90 as shown in FIG. 2. After the piece of mail leaves the encoder induction transport module, it enters the insert induction transport module 45. The inserter induction transport module functions to change the orientation of the piece of mail from vertical to horizontal for placement into the selected carrier 50. In addition, the inserter induction transport module 45 performs a catch-up function in catch-up section 240. The sensor pair 150 and 152 define the beginning and end of the catch-up section 240. It is not necessary to utilize each of the catch-up sections 155, 195 and 240. In fact, depending upon the type of mail flowing through the induction transport modules 20, it may not be necessary to have any of the catch-up sections. Basically, the catch-up sections 155, 195 and 240 function to adjust the position of the piece of mail which position may have been changed due to slippage of the belts within the induction transfer line 25. Such slippage could occur, by, for example, a thick piece of mail (e.g., 1¼ inches) encountering one or more of a series of dancer pulleys 245 shown throughout the induction transfer line 25. The structure of these pulleys is described in copending U.S. patent application entitled Induction Subsystem For Mail Sorting System by Stanley K. Wakamiya et al., filed Aug. 9, 1991, which is hereby incorporated by reference.

Because the FIG. 3 control system monitors the thickness of each piece of mail fed by the auto feeder 30 and manual feeder 35, it is possible to keep track of the total thickness of mail entered each of the bins 60. Thus, the FIG. 3 system maintains the height or total thickness of the mail in each bin 60. It is not necessary for the FIG. 3 control system to monitor the total thickness in this manner. Instead a sensor could be used to determine when a bin is full. When a bin 60 become ¾ full, the FIG. 3 system flashes a warning light 250 that is associated with the ¾ full bin 60. When the bin becomes full, the FIG. 3 system issues a warning by, for example, maintaining the warning light on all of the time; and also maintains any piece of mail destined for that bin in its carrier. In other words, any mail destined for a full bin stays in its selected carrier and circulates through the stacker/transport module 55 until its destination bin is emptied. To empty a bin, an operator pushes a bin button 255 to alert the FIG. 3 control system that the bin is being removed. The FIG. 3 control system also monitors a bin present sensor **260*b* to determine if there is a bin at a desired location. This is useful if, for example, an operator removes a bin without depressing the bin button 255. In addition, in some embodiments of the present invention when the FIG. 3 control system detects that a bin is full, the control system can activate a next bin actuator 265. This actuator moves the full bin out of its location and inserts an empty bin in its place. The stacker/transport module 55 moves the carriers 85 through the stacker/transport module 55 and past the inserter induction transport module 45 at the same rate that the induction transfer line 25** moves. This rate is variable and in one embodiment of the present invention corresponds to 75 inches per second. The rate is variable via operator control, and also in accordance with the state of the system. For example, if the system is recovering from an error then it moves at a much slower rate.

Since the FIG. 3 control system reads the address information from each piece of mail, identifies each piece of mail as it is fed into the induction transfer line 25, and selects an appropriate bin for the piece of mail, it uses this information to maintain on line statistics concerning the mail flowing the system. These statistics can include, for example, the number of pieces of mail sorted to each bin, the number of pieces of mail to each address (e.g., mail stop) or groups of addresses, the number of pieces of mail that were incorrectly read (e.g., the address information read by the bar code reader 225 or optical character reader 215 was not verifiable by the FIG. 3 control system).

The FIG. 3 system includes a set of sort plans. Each sort plan identifies which addresses should be placed in which bin 60 of the stacker/transport module. The operator can select, as discussed below, which sort plan is to be used on a particular sort run. Thus, when the encoder induction transport module obtains the address information from the piece of mail, the FIG. 3 control system searches the selected sort plan for the appropriate bin for the piece of mail placed in.

FIG. 3 is a schematic diagram of a modular mail processing control system embodying the present invention. The FIG. 3 control system includes two computers, a real time CPU 270 and a non real time CPU 275 that is connected to the real time CPU via an Ethernet link 280. The real time CPU controls the mail processing system via a VME bus 285. A serial port controller 290 interfaces a variety of devices with the real time CPU 270 over the VME bus 285. The serial controller 290 communicates with the variety of devices over a communication link identified in FIG. 3 as being an RS-232 connection. This is only one example and the communication can be of any other convenient type. As shown in FIG. 3, the serial controller controls communications between the real time CPU 270 and the bar code reader 220, the OCR 215, the labeler 225, the bar code printer 230, the verify bar code reader 235, a manual feeder scale 300 that is located in the manual feeder 35, and a manual feed terminal 185. The communication through the serial controller 290 is bi-directional for the labeler 225, bar code printer 230 and the manual feed terminal 185. The serial controller 290 interrupts the real time CPU 270 when one of the devices needs to communicate with the real time CPU 270. On being interrupted by the serial controller 290, the real time CPU 270 determines the source of the interrupt (e.g., manual feed terminal) reviews the data received from the device and generates either a message to internal real time CPU software and/or an output to the device. The internal messages are described in more detail below. An interrupt input circuit 305 collects interrupts from various sensors in the system (e.g., carrier empty sensor, the sensors 125–152), the control panel 310 and the servo motors. The interrupt input circuit 305 interrupts the real time CPU 270. The interrupt processing within the real time CPU 270 identifies the source of the interrupt, generates a message to internal real time software and/or an output to respond to the interrupt. All interrupts in the system are generated in a response to a physical event. For example, if an operator presses a system start button on the control panel 310, the interrupting input circuit 305 interrupts the real time CPU 270. Interrupt processing within the real time CPU 270 recognizes that the source of the interrupt is the system control panel and identifies that the system start button has been pressed. In response, the real time CPU generates a message for internal software such as the following.

MSG_SYS_START that is sent to a system state supervisor.

The following table summarizes the interrupts generated by the interrupt input circuit.

TABLE 1

| Interrupt Designation | Description |
|---|---|
| ESTOP | Any of the various emergency stop buttons within the system is pushed |
| InserterEntering | Input from sensor 150 |
| InserterLeaving | Input from sensor 152 |
| AF CatchUpEnter | Input from sensor 125 |
| AF CatchUpEnter | Input from sensor 127 |
| MF CatchUpEnter | Input from sensor 205 |
| CarrierEmpty | Input from carrier empty sensor 110 |
| CarrierFull | Input from carrier full sensor 111 |
| CNTL Panel_Sys Stop | Control Panel 310 system stop button |
| HandAwayMF | Output from safety sensor 315 in the manual feeder 35 |
| ChainStretch | Output of chain stretch |

TABLE 1-continued

| Interrupt Designation | Description |
|---|---|
| | sensor 75 |
| CNTL Panel_SysStart | System start button at control panel 310 pushed |
| MF MailPresent | Mail is present in the manual feeder 35 |
| MLICR MailPresent | Output of sensor 135 |
| MF OverSizedLetter | Output from the pleated belt beat section 190 of the manual feeder 35 |
| Insert Jam Switch | Input from the inserter induction transport module 45 |
| Carrier 1 | Input from carrier 1 sensor 70 |
| AF MailPresent | Output from a sing 320 in the auto feeder 30 |
| MF TwistEnter | Output from sensor 205 |
| MF TwistLeave | Output from sensor 135 |
| MF MergeSuccess | Output of sensor 137 |
| MF InductionJam 1 | Output of sensors in the induction transfer line 25 |
| MF InductionJam 2 | Output of sensors in the induction transfer line 25 |
| MF InductionJam 3 | Output of sensors in the induction transfer line 25 |
| MF InductionJam 4 | Output of sensors in the induction transfer line 25 |
| MF InductionJam 5 | Output of sensors in the induction transfer line 25 |
| MLICR Jam1 | |
| MLICR Jam 2 | |
| Inserter Jam1 | |
| Insert Jam2 | |

Each servo motor generates an interrupt when it acknowledges a command sent from the real time CPU 270. In addition, the real time CPU 270 is interrupted whenever a message is received over the Ethernet link 280. The scale 300 shown in FIG. 1 generates an interrupt when a piece of mail is placed on the cleat belt feed section 190. In addition, a counter/timer 325 generates interrupts for the real time CPU 270 whenever, for example, a counter finishes counting and/or a timer elapses. For example, the output of the encoder 65 in the stacker/transport module 55 is counted by a down counter. When the counter, for example, counts down to 0, an interrupt is generated to indicate that a particular carrier has reached a reference station. The counter is reloaded with the appropriate count so that an interrupt is generated when the next carrier arrives at the reference position. This technique permits variable spacing between the carriers.

As shown in FIG. 3, A to D converters 330 provide digital output of the scale 300 to the real time CPU 270. In FIG. 3, reference numeral 335 designates a PAMUX I/O Bus controller. An embodiment of the present invention uses a XYCOM VME Bus PAMUX I/O type bus controller. This controller interfaces the sensors and actuators for the stacker/transport module 55, the lights and alarm indicators on the control panel 310 and the AC synchronous motors such as 165, 170 and 175 shown in FIG. 1. This controller also interfaces the real time CPU 270 with each of the servo motors so as to control the starting and stopping of the servo motors. Referring to FIG. 2, 3 bin modules in the stacker/transport module are illustrated. In each module, there is a diverter 95, warning light 250, bin present sensor 260, a bin button 255 and an optional next bin actuator 265 for each bin location. For the 27 bin stacker/transport module 55 shown in FIG. 2, these sensors and actuators require 135 input output lines. Thus necessitating a bus controller such as the PAMUX I/O bus controller 325. As shown in FIG. 3, the sensors and actuators as discussed above are isolated from the PAMUX I/O Bus Controller 335 by isolation modular boards 340.

Figure 4:
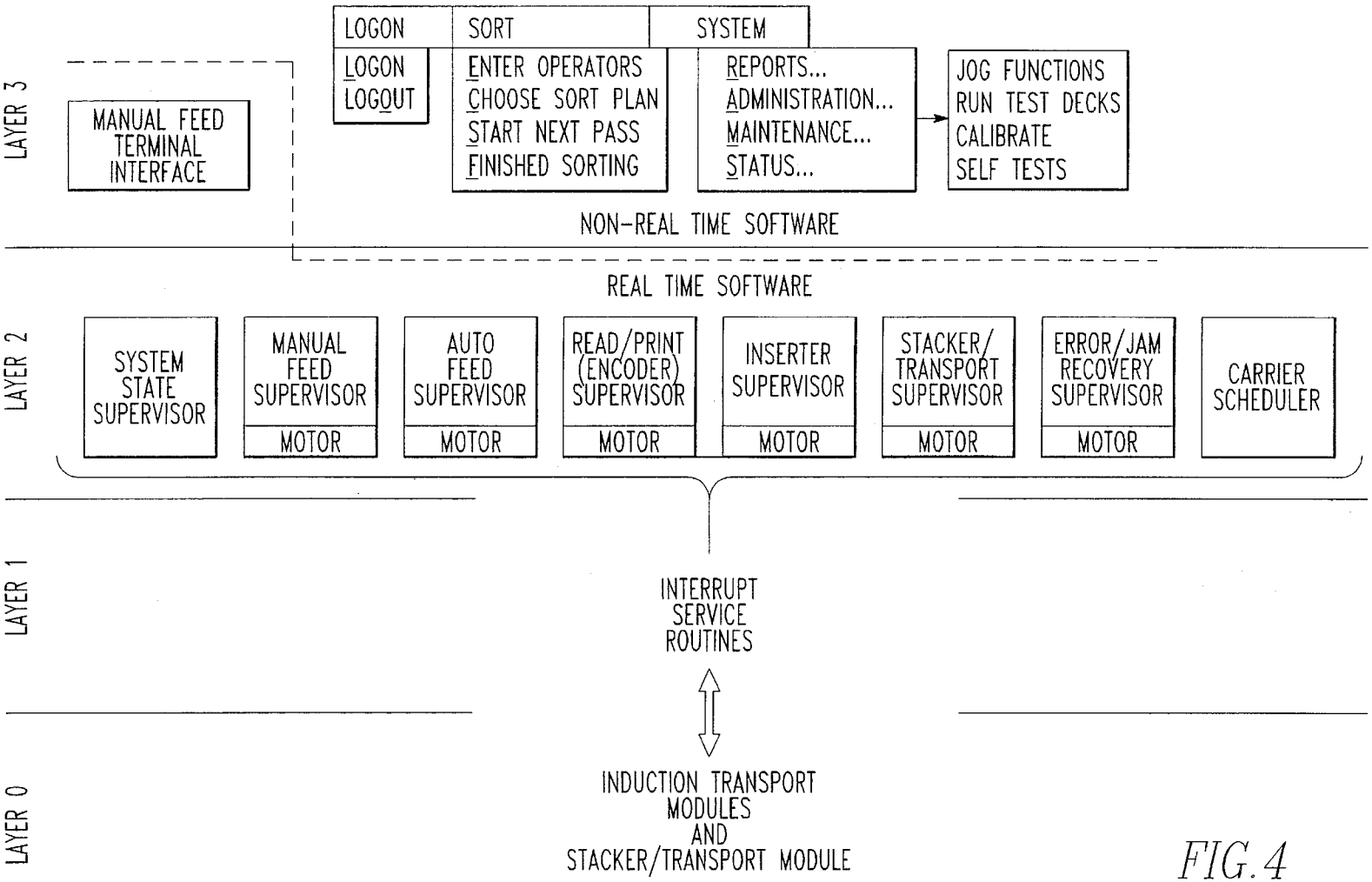
FIG. 4 is a schematic diagram of an embodiment of the modular processing control system software in accordance with the present invention.

FIG. 4 is a schematic diagram of an embodiment of the modular processing control system software in accordance with the present invention. The modular mail processing control software is structured, as shown in FIG. 4 into non real time software and real time software. The non real time software is associated with the system console associated with the non real time CPU 275. As schematically illustrated in FIG. 4, interrupt service routines (ISR) interface the real time software with the actual induction transport modules 20 and stacker/transport module 55. As mentioned above, each physical event in the induction transport modules 20 causes an interrupt. An interrupt service routine recognizes the source of the interrupt, issues a response to the source, and if needed generates a message to one of the modules of the real time software shown in FIG. 4. The message is passed amongst the real time software modules shown in FIG. 4 and the interrupt service routines and over the Ethernet 280*s* is in accordance with the known TCP/IP communication protocol. On powering up both the real time CPU275, the non real time CPU 275 enters a server listen mode, and waits for the real time 270 to issue a connect message. Upon receipt of the connect message, the non real time CPU 275 issues an accept message to establish a communication link over the Ethernet 280. The non real time CPU 275 begins the system console software as described in more detail below.

Figure 5:
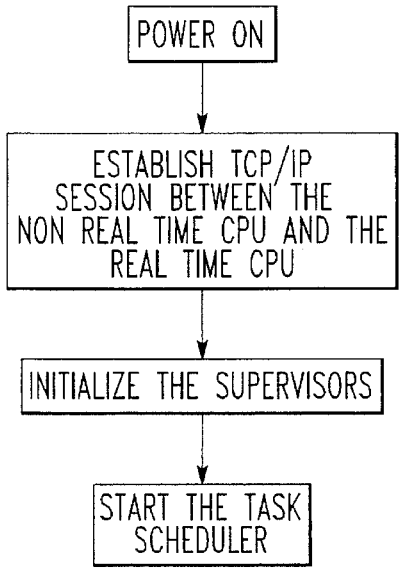
FIG. 5 is a logic diagram of the bootstrap processing.

After establishing the session with the non real time CPU 275, the real time CPU 270 initializes each of the supervisor tasks shown in FIG. 4. This is accomplished by, and is explained in more detail below, placing a message MSG_INIT in a message queue for each of these supervisors. The system task schedule is then started. This processing is schematically illustrated in FIG. 5 which represents the bootstrap processing performed in the real time CPU 270.

Figure 6:
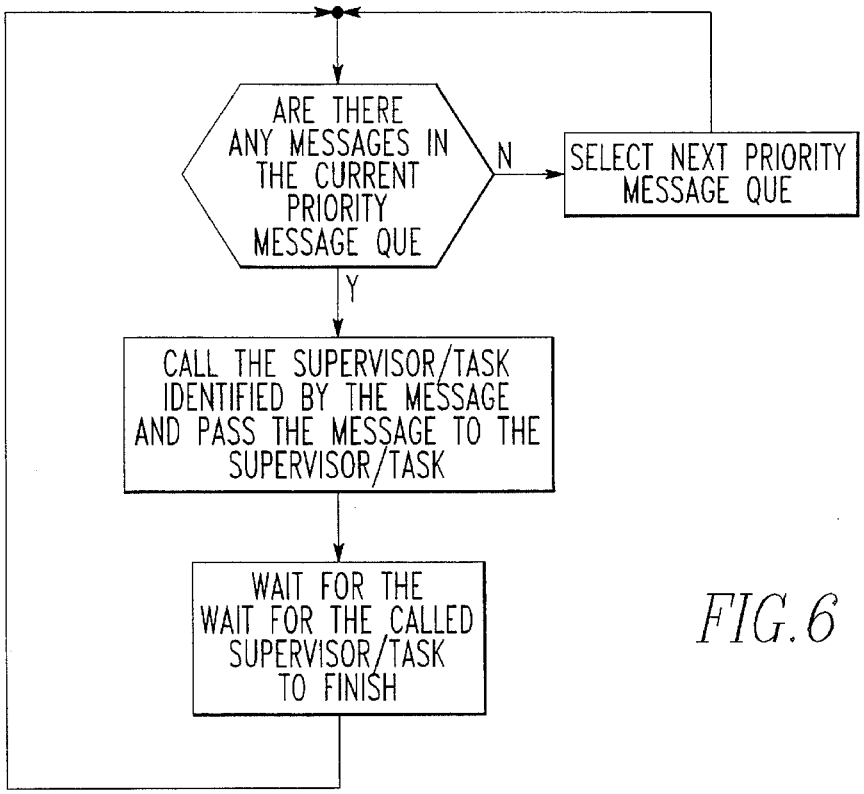
FIG. 6 is a flow diagram of the task scheduler.

FIG. 6 is a flow diagram of the task scheduler. The task scheduler is a non-preemptive multi-tasking kernel which passes messages between supervisors and tasks shown in layer 2 of FIG. 4 and accepts messages from interrupt service routines shown in layer 1 of FIG. 4. These messages are passed through a series of message queues; each queue having a priority. Within each priority, the message queue functions as a first in, first out queue. As shown in FIG. 6, the task scheduler handles all of the messages in the current priority before continuing to the next priority.

FIG. 7 is a flow diagram of the manual feed terminal interface real time software module. In step SI, it is determined whether or not the current sort is an automatic sort or one which requires the operator of the manual feeder 35 to enter a mail stop. If it is an automatic mail sort, processing proceeds to step S6. In this step, a message is sent to the manual feed supervisor which then sends a message to the carrier scheduler to feed the piece of mail. The carrier scheduler will then place a message in the message queue for the interrupt service routines to activate the cleated belt servomotor 210 to begin feeding the piece of mail into the induction transfer line 25 shown in FIG. 1. Referring to FIG. 7, if mail stops should be entered by the operator of the manual feeder 35, the system requests that the operator enter a mail stop as shown in the screen illustrated in FIG. 8. If a mail stop is entered, processing proceeds to step S6 as described above. If a mail stop has not been entered, the processing proceeds to step S3 shown in FIG. 7. Referring to FIG. 8, the operator is prompted to enter a name in step S3 of FIG. 7. The names that match are then displayed by step S4 shown in FIG. 7. The operator chooses one of the names by entering the number associated with the desired name. If a name is chosen in step S5 of FIG. 7, then processing continues to step S6 as discussed above. Otherwise, the operator is requested to enter a name again in step 53 of FIG. 7.

The following describes the structure and operation of the layer 2 supervisors and tasks shown in FIG. 4; that is, the Manual Feed Supervisor, the Auto Feed Supervisor, the Read/Print (i.e., encoder) Supervisor, the Inserter Supervisor, the Stacker/Transport Supervisor, the Error/Jam Recovery Supervisor, the Carrier Scheduler and the System State Supervisor. Referring the FIGS. 1 and 4, the Manual Feed Supervisor controls the operation of the manual feeder 35 as schematically represented by the boxed portion of the system shown in FIG. 1. The auto feed supervisor controls the operation of the auto feeder 30 and portion of the induction transport modules 20 as schematically illustrated by the box shown in FIG. 1. The read/print (encoder) supervisor controls the operation of the read/print (encoder) induction transport module 40 as schematically illustrated by the box shown in FIG. 1. The inserter supervisor controls the operation of the inserter module 45 as schematically illustrated by the box shown in FIG. 1. The stacker/transport supervisor controls the operation of the stacker/transport module 55 shown in FIGS. 1 and 2.

In the following, each of the supervisors and tasks is discussed with respect to its Moore machine state table which are to be read and together with the message data dictionary and Appendix A. In addition, Appendix A identifies each message used within the software shown in FIG. 4. The message name is shown in capitals and the parameter, if any is shown in lower case underneath the message name. In the Description portion of Appendix A names having a prefix "isr" identify interrupt service routines for example, referring to the description associated with the message MSG_ESTOP in Section 1.1 of Appendix A, the source of this message is the interrupt service routine "isrESTOP." Thus, the source of the input message MSG_ESTOP is the interrupt service routine "isrESTOP". The message is triggered by any one of the emergency stop (E-Stop) buttons being pressed on any one of the induction transfer modules 20 or the stacker/transport module 55. Where the parameter associated with the message MSG_ESTOP is a boolean parameter that is true if the button is pressed and false if the button is not pressed or reset.

Figure 9:
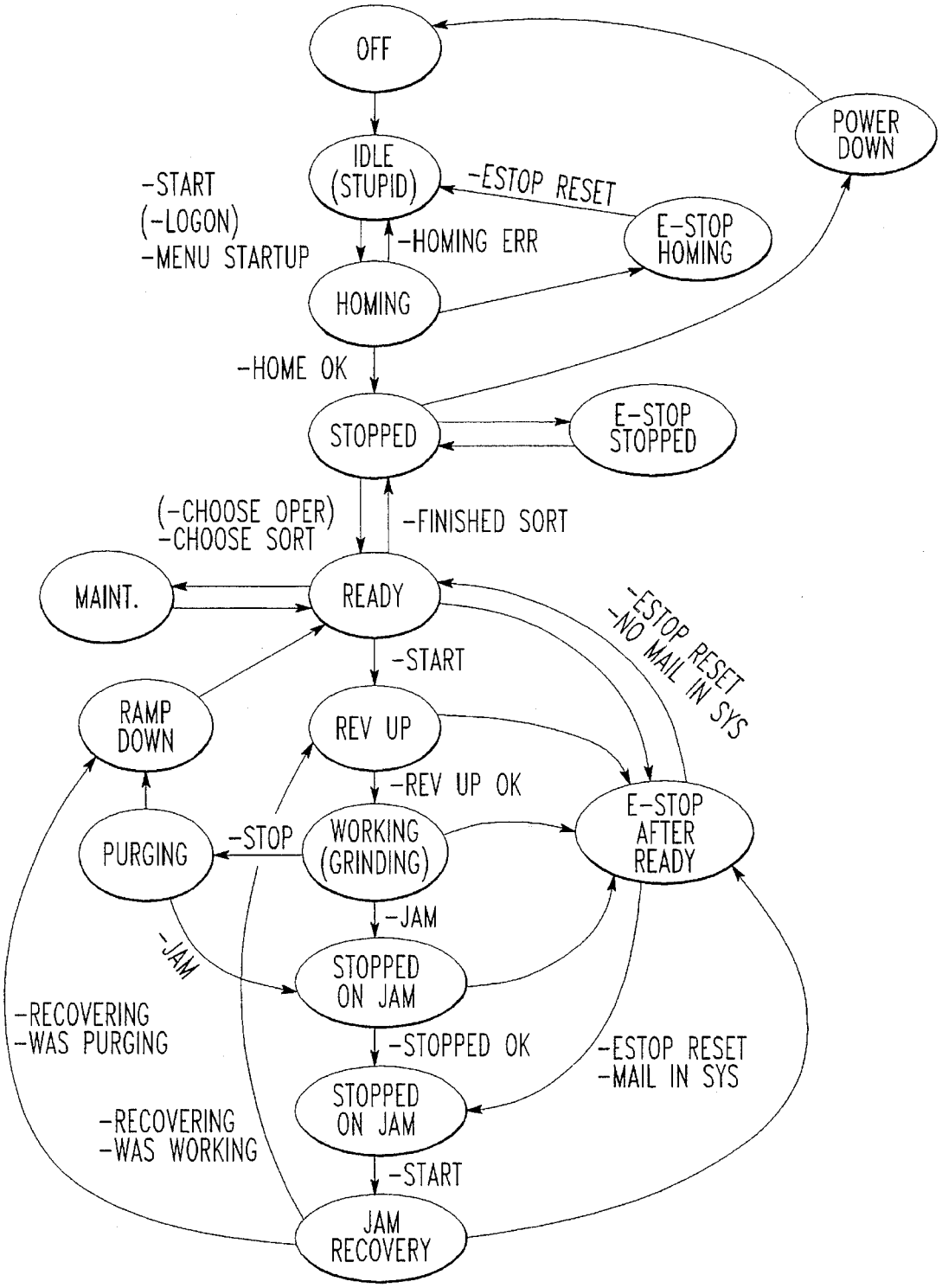
FIG. 9 is a simplified state diagram for the system state supervisor.

FIG. 9 is a simplified state diagram for the system state supervisor. Appendix B is the Moore machine state table for the system state supervisor. This state table is organized in the same way as all of the remaining state tables. There are four columns in each state table. The first identifies the present state, the second identifies the message input to that state, the third column identifies the next state, and the fourth column identifies the message output by the present state. The manual feed supervisor comprises two state tables. Appendix C is the state table for the manual feeder terminal 185 and cleat belt feed section 190 of the manual feeder induction transport module 35. Appendix D is the state table for the catch space up section 195 of the manual feeder induction transport module 35. The auto feed supervisor comprises three state tables. The first shown in Appendix E shows the auto feeder singulator 320. The second presented in Appendix F controls the actual catch up or position adjustment of a piece of mail within the auto feeder catch up section 155. The last state diagram for the auto feed supervisor is presented in Appendix G which controls the calculation of the amount of adjustment to the piece of mail that is to be made by the catch up section 155. The state machine shown in Appendix G also controls the general operational state of the catch up section 155 including its rev up, ramp down and stopping on a position error or jam detection as shown in Appendix G. The amount of position adjustment to be made by the catch up section 155 is based upon the difference between the desired position of the carriers within the stacker/transport module 55 and the actual position as determined by encoder 65. The difference between these two positions identifies the amount of position adjustment to be made by the catch up section 155.

The read/print (Encoder) supervisor state diagram is presented in Appendix H. The state diagram presented in Appendix H controls only the OCRN 215 shown in FIG. 1.

The inserter supervisor state machine actually comprises two state machines. Appendix K presents the state machine for the catch up section 240. This state machine controls when the position adjustment to be affected by the inserter induction transport module 45 should begin and end. The state machine shown in Appendix I is similar to that discussed with respect to the auto feed catchup date machine presented in Appendix F. That is, the Inserter supervisor state machine presented Appendix J controls the general operational state of the inserter and calculates the amount of position adjustment to be made by the inserter in the same manner as described with respect to the auto feed catch up section 155.

The Stacker/Transport Supervisor state machine is presented in Appendix K, and the Error/Jam recovery supervisor is presented in Appendix L.

The carrier scheduler is not a state machine and therefore Appendix M presents the pseudocode for the carrier scheduler. Both the manual feed supervisor and the auto feed supervisor send messages to the carrier scheduler via the task scheduler and associated message queues. These messages identify which of the feeders, the automatic feeder induction transport module 30 or the manual feeder induction transport module 35 has sent the request to feed a piece of mail.

Figures 12, 13:
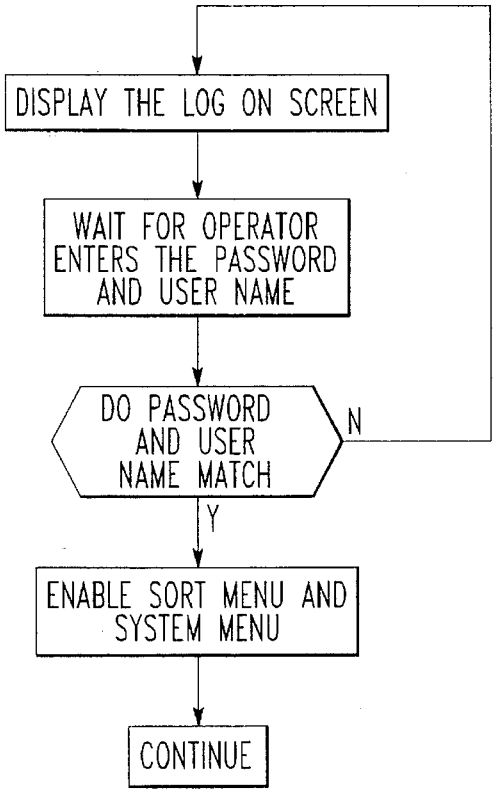
FIG. 12 illustrates the display 10 provided at the non real time CPU 275 when displaying the status of the system.
FIG. 13 is a logic flow diagram of the log on screen process shown in FIG. 10.

In an embodiment of the present invention, the non real time software is implemented using Microsoft® Windows. As shown in FIG. 4, on power up after the non real time CPU 275 and the real time CPU 270 establish a connection as described above, the non real time CPU 275 such as shown above the dotted line portion of FIG. 4. Basically, the non real time software has log on functions, sorting functions and system functions. FIG. 10 is a logic flow diagram of the process performed to enable the system to perform a sort. FIGS. 11A–11D illustrate the screens displayed by the non real time CPU 275 during the process illustrated in FIG. 10. FIG. 12 illustrates the display provided at the non real time CPU 275 when displaying the status of the system.

FIG. 13 is a logic flow diagram of the log on screen process shown in FIG. 10. In FIG. 13, the first step is to display the log on screen such as shown in FIG. 11A. At this point, the system waits for the operator to enter a password and a user name. The system then checks to see if the password matches the appropriate password for the user name. If not, the log on screen is again displayed. If the password and user name match, the sort and system menus shown in FIG. 4 are enabled and processing continues as shown in FIG. 10. As is common with programs written with Windows, if the operator selects either the OK area or the Cancel area, processing continues to the next process shown in FIG. 10.

Figure 14:
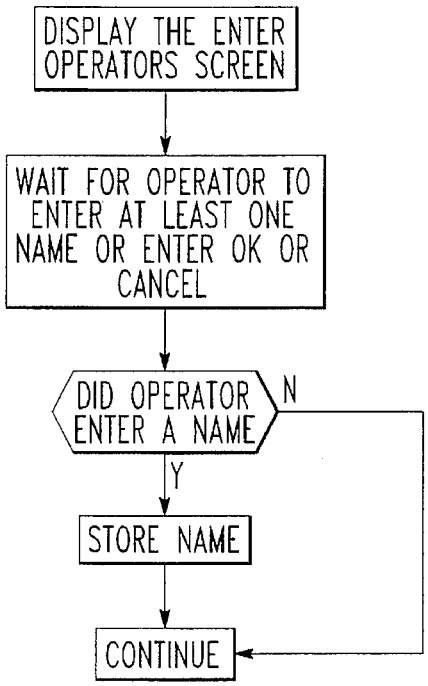
FIG. 14 is a logic flow diagram of the Enter Operators Processing shown in FIG. 10.

FIG. 14 is a logic flow diagram of the Enter Operators Processing shown in FIG. 10. The first step is to display the inter operators screen. At this point, the system waits for the operator to enter at least one name. As discussed with respect to FIG. 11A, the operator can select either the OK or Cancel area and leave the operation. If the operator enters a name, the name is stored and processing continues as shown in FIG. 10.

Figure 15:
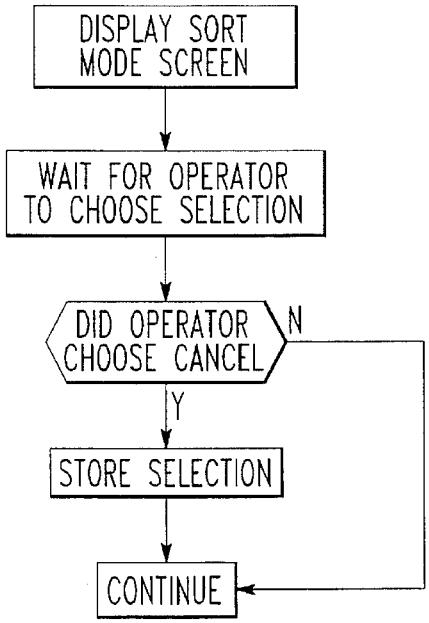
FIG. 15 is a logic flow diagram of the Choose Sort Type process shown in FIG. 10.

FIG. 15 is a logic flow diagram of the Choose Sort Type process shown in FIG. 10. Referring the FIG. 11C and to FIG. 15, the sort mode screen is displayed first. The system then waits for the operator to choose one of the selections. If the operator chooses cancel, the processing continues as shown in FIG. 10 otherwise the selection is stored and processing continues as shown in FIG. 10.

FIG. 16 is a logic flow diagram for the Choose Sort Plan processing shown in FIG. 10. Referring the FIG. 16 and FIG. 11D the Choose Sort Plan Screen is first displayed. Next, the sort plans associated with the sort mode are displayed and the system waits for the operator to select a sort plan. If no sort plan is selected, the system start button on the control panel shown in FIG. 3 is nonfunctional. When the operator selects a sort plan, the selected sort plan is then sent to the real time CPU 270, and processing continues as shown in FIG. 10. More particularly, the status such as shown in FIG. 12 is displayed as the non real time CPU 275.

Referring to FIG. 4, a user has the ability to select system functions such as reports, administration (i.e. display of user information) as well as maintenance functions. FIG. 17 illustrates a display as the non real time CPU 275 that occurs when an operator selects the reports option shown in FIG. 4. The operator uses this screen to select which of the information stored by the FIG. 3 control system is to be printed. For example, the operator could print a distribution report showing the number of pieces of mail distributed to each of the bins shown in FIG. 2.

Figure 18:
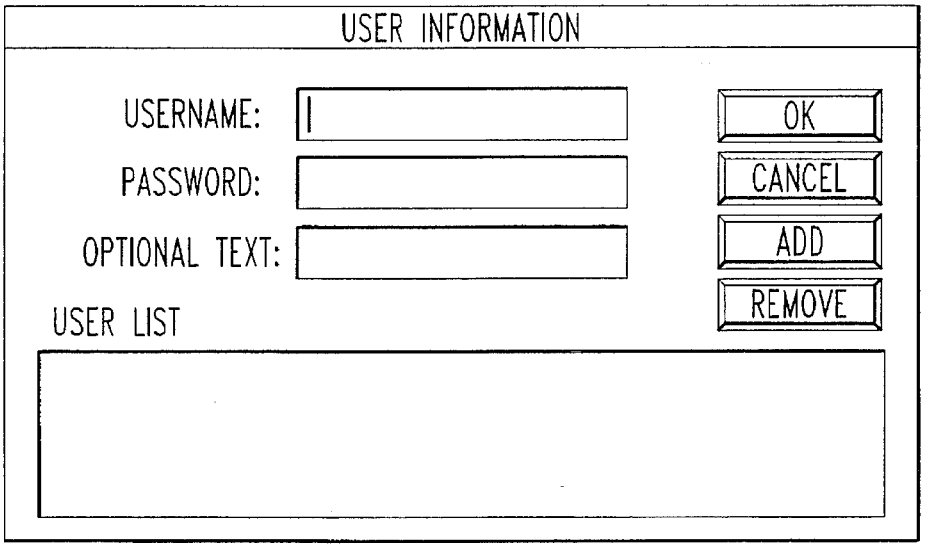
FIG. 18 illustrates the display at the non real time CPU 275 when the operator selects the administration option.
Figure 19:
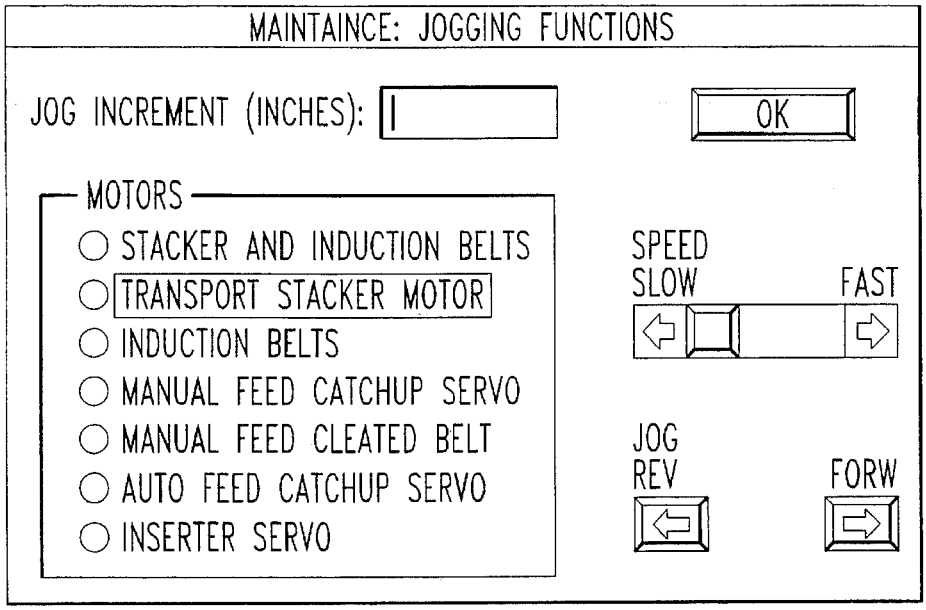
FIG. 19 illustrates the display at the non real time CPU 275 when the operator selects the maintenance option.

FIG. 18 illustrates the display at the non real time CPU 275 when the operator selects the administration option. This display promises the user to enter his name and password or to change the password. The display in FIG. 18 could restrict modification of the information based upon the status of the operator. For example, only an administrator could change the password. FIG. 19 illustrates the display at the non real time CPU 275 when the operator selects the maintenance option.

Figure 20:
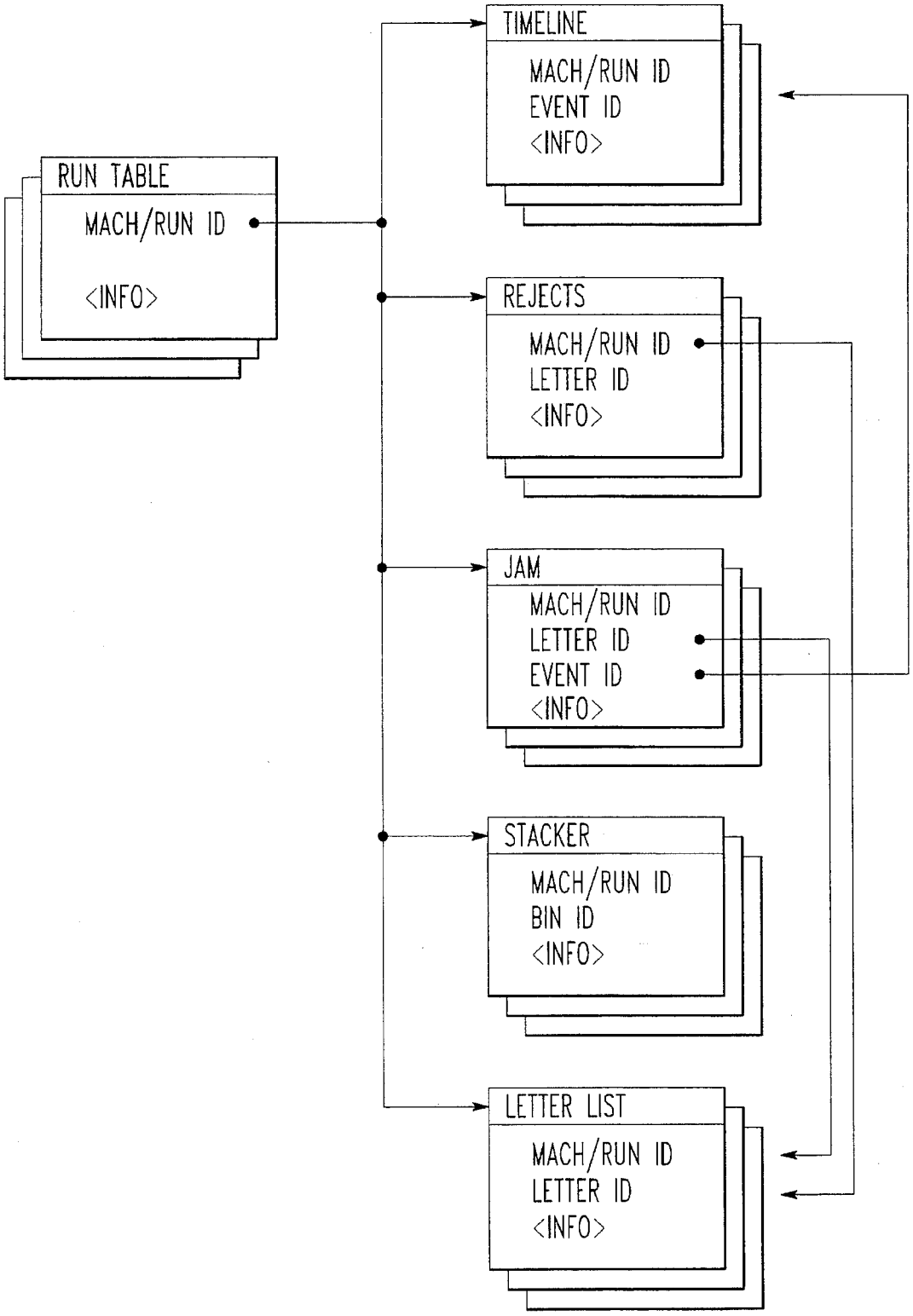
FIG. 20 is a schematic diagram of the real time statistics maintained by the FIG. 3 controller.

FIG. 20 is a schematic diagram of the real time statistics maintained by the FIG. 3 controller. As illustrated in FIG. 20, the statistics are maintained in a linked list fashion. FIGS. 21A–21C provide an example of the type of information maintained by the non real time CPU 275.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

APPENDIX A

1. System State Supervisor
1.1 Input Messages

| Message<br>Parameter | Description |
|---|---|
| MSG_INIT | Initialize variables and data structures |
| Source | Boot strap program |
| MSG_ESTOP | |
| Source | irsEstop, triggered by any of the E-Stop buttons interrupts on leading and trailing edge of E-Stop signal |
| wParam | TRUE =button pressed, FALSE =button reset |
| MSG_SYS_STOP | |
| Source | irsSysStop, triggered by operator pressing stop on the system control panel. Leading edge triggered only |
| MSG_MENU_STARTUP | |
| Source | SUPV_SYS_CONSOLE, the non-real time PC. The operator selected "Start next pass" from the main menu. |
| MSG_SORT_PLAN | |
| Source | SUPV_SYS_CONSOLE. The operator has chosed a sor |
| MSG_FINISHED_SORT | |
| Source | SUPV_SYS_CONSOLE. The operator selected "Finished Sort". |
| MSG_MAINTENANCE | |
| Source | SUPV_SYS_CONSOLE. The operator selected a maintenance function. |
| MSG_HOME_OK | |
| Source | Motor Supervisors. Sent in response to a SST_GO_HOME from SUPV_SYS_STATE. Sent when the homing procedure in complete. |
| wParam | TRUE =homing was successful, FALSE =homing was not successful |
| MSG_REV_UP_OK | |
| Source | Motor Supervisors. Sent in response to a SST_REV_UP from SUPV_SYS_STATE. Sent when the rev up is complete. |
| wParam | TRUE =rev up was successful, FALSE =rev up failed |
| MSG_JAM | |
| Source | Any Motor Supervisor. A jam has been detected. |
| lParam | pointer to the letter record |
| MSG_STOP_ON_JAM_OK | |
| Source | Motor Supervisors. Sent in response to a SST_STOP_ON_JAM. Sent when the motots have come to a complete stop. |
| wParam | TRUE =Stopped sucessfully, FALSE =stop has not suceeded (this is a serious error) |
| MSG_RECOVERED_OK | |
| Source | Motor Supervisors. Sent in response to a SST_IS_RECOVERED. Sent when there is no more mail in the "domain" of the supervisor (this happens during jam recovery). |
| MSG_PURGED_OK | |
| Source | Motor Supervisors. Sent in response to a SST_IS_PURGED. Sent when there is no more mail in the "domain" of the supervisor. |
| MSG_RAMP_DOWN_OK | |
| Source | Motor Supervisors. Sent in response to a SST_RAMP_DOWN. Sent when the motors have come to a complete stop. |
| wParam | TRUE =ramped down successfully, FALSE =failure ramping down (this is a serious error). |
| MSG_MAIL_IN_SYS | |
| Source | Motor Supervisors. Sent in response to a SST_IS_MAIL_IN_SYS. |
| wParam | TRUE =mail is in the supervisor's domain. FALSE =there is no mail in the supervisor's domain |

1.2. Output Messages

| Message<br>Parameter | Description |
|---|---|
| MSG_SYS_STATE | |
| wParam | SST_ESTOPPED |
| Dest | Motor Supervisors. Tells them an E-stop has occurred |
| MSG_SYS_STATE | |
| wParam | SST_GO_HOME |
| Dest | Motor Supervisors. Tells them to start their homing procedure. Each supervisor must return a MSG_HOME_OK when the homing is complete. Supervisors that don't require homing may return a MSG_HOME_OK immediately. |
| MSG_SYS_STATE | |
| wParam | SST_STOPPED |
| Dest | Motor Supervisors. Says we are in state ST_STOPPED |
| MSG_SYS_STATE | |
| wParam | SST_IDLE |

APPENDIX A-continued

| | |
|---|---|
| Dest | Motor Supervisors. Says we are in state ST_IDLE |
| MSG_SYS_STATE | |
| wParam | SST_READY |
| Dest | Motor Supervisors. Says we are in state ST_READY |
| MSG_SYS_STATE | |
| wParam | SST_REV_UP |
| Dest | Motor Supervisors. Tells them to start rev up procedure; turn the motors on, etc. Each motor supervisor must return a MSG_REV_UP_OK when the motors are up to speed. |
| MSG_SYS_STATE | |
| wParam | SST_GRINDING |
| Dest | Motor Supervisors. Says we are in state ST_GRINDING |
| MSG_SYS_STATE | |
| wParam | SST_PURGING |
| Dest | Motor Supervisors. Says we are in state ST_PURGING. |
| MSG_SYS_STATE | |
| wParam | SST_IS_PURGED |
| Dest | Motor Supervisors. Asks a supervisor to return a MSG_PURGED_OK once all mail pieces are out of its "domain". |
| MSG_SYS_STATE | |
| wParam | SST_STOP_ON_JAM |
| Dest | Motor Supervisors. Says that we are in ST_STOPPING_ON_JAM. Each motor supervisor must return a MSG_STOP_ON_JAM_OK once the motors have come to a stop. |
| MSG_SYS_STATE | |
| wParam | SST_STOPPED_ON_JAM |
| Dest | Motor Supervisors. Says we are in state ST_STOPPED_ON_JAM |
| MSG_SYS_STATE | |
| wParam | SST_JAM_RECOVERY |
| Dest | Motor Supervisors. Says we are in state ST_JAM_RECOVERY |
| MSG_SYS_STATE | |
| wParam | SST_IS_RECOVERED |
| Dest | Motor Supervisors. Asks a supervisor to return a MSG_RECOVERED_OK as soon as all the mail in its "domain" is gone. |
| MSG_SYS_STATE | |
| wParam | SST_RAMP_DOWN |
| Dest | Motor Supervisors. Tells the motor supervisors to ramp down the motors. Each supervisor must return a MSG_RAMPED_DOWN_OK as soon as the motors have come to a stop. |
| MSG_SYS_STATE | |
| wParam | SST_IS_MAIL_IN_SYS |
| Dest | Motor Supervisors. Asks a supervisor whether there are any mail pieces in its domain. Each supervisor should respond immediately with a MSG_MAIL_IN_SYS. |

2. Carrier Scheduler 2.1. Input Messages

| Message<br>Parameter | Description |
|---|---|
| MSG_INIT | Initialize variables and data structures |
| Source | Boot strap program |
| MSG_SHUTDOWN | |
| MSG_CARRIER_REQUEST | |
| Source | Feeder supervisors: which feeder wants a carrier |
| wParam | sizeof (LETTER) |
| lParam | pointer to a LETTER structure |
| MSG_CANCEL_REQUEST | |
| Source | Feeder supervisors: which feeder doesnt want a carrier |
| wParam | sizeof (LETTER) |
| lParam | pointer to a LETTER structure |

2.2.Output Messages

| | |
|---|---|
| MSG_INCOMING | This tells the feeder that the letter has been scheduled for liftoff and will be moving shortly |
| wDest | which feeder made the original request |
| wParam | sizeof (LETTER) |
| lParam | pointer to a LETTER structure |

3. Manual Feed Function 3.1.Input Messages

The manual feed supervisor processes many messages, mostly from its own ISRs. Extra parameters are noted where appropriate:

| Message<br>Parameter | Description |
|---|---|
| MSG_INIT | Initialize variables and data structures |
| Source | Boot strap program |

APPENDIX A-continued

| | |
|---|---|
| MSG_SYS_STATE | (See section 2. for details on how motor supervisors must respond to MSG_SYS_STATE messages) |
| MSG_MAIL_PRESENT | |
| Source | ISR Mail Present. The mail present sensor has been interrupted. |
| wParam | TRUE =sensor is bocked, FALSE =sensor is unblocked |
| MSG_MAILSTOP | Contains the mail stop |
| Source | Manual Feed Terminal ISR |
| lParam | pointer to the Zip+ 4 value |
| MSG_WEIGHT | Contains the weight of the piece |
| Source | Manual Feed Scale ISR |
| wParam | the weight in 100ths of an oz. |
| MSG_HAND_AWAY | |
| Source | the hand away sensor ISR has changed |
| wParam | TRUE =hand is out of the way, FALSE =hand is in the way. |
| MSG_CANCEL | the operator wants to cancel the last typed value. |
| Source | the manual feed terminal |
| MSG_CLEAR | |
| Source | the cleated belt motor ack. This means the cleated belt is back in position to feed another mail piece. |
| MSG_POLL | This message is used to poll sensors. |
| Dest | Manual Feed Supervisor |
| Source | Manual Feed Supervisor |
| MSG_CATCHUP_ENTER | |
| Source | Catchup enter sensor isr. Triggers on both negative and positive transitions. |
| MSG_CATCHUP_CLEAR | |
| Source | Catchup motor ack isr. The cleated belt is back home. |

3.2.Output Messages

| Message<br>Parameter | Description |
|---|---|
| MSG_CARRIER_REQUEST | Asks the carrier scheduler to feed this mail piece! |
| lParam | Pointer to a LETTER structure for the new mail piece. |
| Source | Indicates which feeder made the request |
| Dest | Carrier Scheduler Supervisor |
| MSG_POLL | Used to poll a sensor. |
| Source | Man Feed Supervisor. |
| Dest | Man Feed Supervisor. |
| MSG_INCOMING | |
| Dest | Read/Print Supervisor. This message tells the read/print supervisor that a letter had been fed and is on its way. |
| lParam | pointer to a letter structure. |

(NOTE: see section 2. for details on the following messages)
MSG_MAIL_IN_SYS
MSG_HOME_OK
MSG_REV_UP_OK
MSG_RAMP_DOWN_OK
MSG_STOP_ON_JAM_OK
MSG_PURGED_OK
MSG_RECOVERED_OK 4. Auto Feed Supervisor 4.1.Input Messages

| Message<br>Parameter | Description |
|---|---|
| MSG_INIT | Initialize variables and data structures |
| Source | Boot strap program |
| MSG_SYS_STATE | (See section 2. for details on how motor supervisors must respond to MSG_SYS_STATE messages) |
| MSG_MAIL_PRESENT | |
| wSource | mail present sensor ISR. Triggers on both negative and positive transitions. |
| wParam | TRUE =mail is present (sensor is blocked)<br>FALSE =mail is not present (sensor is not blocked) |
| MSG_CLEAR | |
| wSource | auto feed singulator motor ack ISR. The letter has moved clear off the singulator roller. |
| MSG_POLL | Used to poll a sensor. |
| Source | Auto Feed Supervisor. |
| Dest | Auto Feed Supervisor. |
| MSG_AF_CATCHUP_ACK | |
| Source | auto feed catchup motor ack ISR. The motor has completed |

APPENDIX A-continued

| | |
|---|---|
| | a command. |

4.2.Output Messages

| Message<br>Parameter | Description |
|---|---|
| (Same as the Manual Feed Output Messages) | |

5. Read/Print Supervisor 5.1.Input Messages

| Mgessage<br>Parameter | Description |
|---|---|
| MSG_INIT | Initialize variables and data structures |
| Source | Boot strap program |
| MSG_SYS_STATE | (See section 2. for details on how motor supervisors must respond to MSG_SYS_STATE messages) |
| MSG_INCOMING | |
| Source | Manual or Automatic feeder Supervisor. Tells how read/print supervisor that a letter has been fed onto the induction pich belts and is on its way |
| wParam | size_of (LETTER) |
| lParam | pointer to a letter record |
| MSG_POLL | Used to poll a sensor. |
| Source | Read/Print Supervisor. |
| Dest | Read/Print Supervisor. |

5.2.Output Messages

| Message<br>Parameter | Description |
|---|---|
| MSG_POLL | Used to poll a sensor. |
| Source | Read/Print Supervisor. |
| Dest | Read/Print Supervisor. |
| MSG_INCOMING | |
| Dest | Inserter Supervisor. This message tells the inserter supervisor that a letter has been fed and is on its way. |
| lParam | pointer to a letter structure. |

(NOTE: see section 2. for details on the following messages)
MSG_MAIL_IN_SYS
MSG_HOME_OK
MSG_REV_UP_OK
MSG_RAMP_DOWN_OK
MSG_STOP_ON_JAM_OK
MSG_PURGED_OK
MSG_RECOVERED_OK 6. Inserter Supervisor 6.1.Input Messages

| Message<br>Parameter | Description |
|---|---|
| MSG_INIT | Initialize variables and data structures |
| Source | Boot strap program |
| MSG_SYS_STATE | (See section 2. for details on how motor supervisors must respond to MSG_SYS_STATE messages) |
| MSG_INS_MOTOR_ACK | |
| Source | inserter motor ack isr. This message is sent when the motor has completed a command. |
| MSG_POLL | Used to poll a sensor. |
| Source | Inserter Supervisor. |
| Dest | Inserter Supervisor. |
| MSG_INCOMING | |
| Source | Read/Print Supervisor. Tells the inserter supervisor that a letter is on its way |
| wParam | size_of (LETTER) |
| lParam | pointer to a letter record |

6.2.Output Messages

| Message<br>Parameter | Description |
|---|---|
| MSG_JAM | |
| wParam | Jam error code, letter was too late or too early |
| lParam | Jam Location |
| MSG_POLL | Used to poll a sensor. |
| Source | Inserter Supervisor. |
| Dest | Inserter Supervisor. |
| MSG_INCOMING | |

APPENDIX A-continued

| | |
|---|---|
| Dest | Stacker Supervisor. Tells the stacker supervisor that a letter is on its way. |
| wParam | size_of (LETTER) |
| lParam | pointer to a letter record |

(NOTE: see section 2. for details on the following messages)
MSG_MAIL_IN_SYS
MSG_HOME_OK
MSG_REV_UP_OK
MSG_RAMP_DOWN_OK
MSG_STOP_ON_JAM_OK
MSG_PURGED_OK
MSG_RECOVERED_OK 7. Stacker Scheduler 7.1.Input Messages

| Message Parameter | Description |
|---|---|
| MSG_INIT | Initialize variables and data structures |
| Source | Boot strap program |
| MSG_SYS_STATE | (See section 2. for details on how motor supervisors must respond to MSG_SYS_STATE messages) |
| MSG_STK_MOTOR_ACK | |
| Source | stack motor ack isr. This message is sent when the motor has completed a command. |
| MSG_POLL | Used to poll a sensor. |
| Source | Stacker Supervisor. |
| Dest | Stacker Supervisor. |
| MSG_INCOMING | |
| Source | Inserter Supervisor. Tells the stacker supervisor that a letter is on its way |
| wParam | size_of (LETTER) |
| lParam | pointer to a letter record |

7.2.Output Messages

| Message Parameter | Description |
|---|---|
| MSG_POLL | Used to poll a sensor. |
| Source | Stacker Supervisor. |
| Dest | Stacker Supervisor. |
| MSG_INCOMING | |
| Dest | System Console Supervisor (non-real time PC). Tells the system console and database that the letter has been sorted into a bin. |
| wParam | size_of (LETTER) |
| lParam | pointer to a letter record |

(NOTE: see section 2. for details on the following messages)
MSG_MAIL_IN_SYS
MSG_HOME_OK
MSG_REV_UP_OK
MSG_RAMP_DOWN_OK
MSG_STOP_ON_JAM_OK
MSG_PURGED_OK
MSG_RECOVERED_OK 8. Error/Jam Supervisor 8.1.Input Messages

| Message Parameter | Description |
|---|---|
| MSG_INIT | Initialize variables and data structures |
| Source | Boot strap program |
| MSG_SYS_STATE | (See section 2. for details on how motor supervisors must respond to MSG_SYS_STATE messages) |
| MSG_JAM | |
| Source | jam sensor isr. One of the sensors detected a jam. |
| wParam | sizeof (JAM_DATA) |
| lParam | pointer to a letter record and a cause code |

8.2.Output Messages

| Message Parameter | Description |
|---|---|
| MSG_JAM | |
| Dest | System State Supervisor. Tells the system state supervisor that a jam has occurred. |
| lParam | pointer to a letter record |
| MSG_KILL_LETTER | |

APPENDIX A-continued

| | |
|---|---|
| Dest | Motor Supervisors. Tells each motor supervisor to search its data for the letter specified in the lParam. If the letter is present, delete it from the data. MSG_KILL_LETTER is sent when the operator removes a piece from the induction line after a jam. |
| lParam | pointer to a letter record |

(NOTE: see section 2. for details on the following messages)
MSG_MAIL_IN_SYS
MSG_HOME_OK
MSG_REV_UP_OK
MSG_RAMP_DOWN_OK
MSG_STOP_ON_JAM_OK
MSG_PURGED_OK
MSG_RECOVERED_OK
9. System Console
9.0. Typical Format for messages
Header [Data]
The header will contain what type of message. The type will determine what kind of data follows. Data is optional.
Input Messages (Real-Time to System Console)

| | |
|---|---|
| RTMSG_HELLO | - Lets the system console establish a session when the RT boots up. |
| RTMSG_LETTER | - Contains letter information, 4 letters/sec max |
| RTMSG_JAM | - Letter that was jammed and its location |
| RTMSG_TIMELINE | - Each event that needs to be recorded (E-Stops, Jams, Maintenance) |

NOTE: HMS, Advantage to splitting the status up is you need only 1 case statement to figure out where to put the information (simplifies the code).
If you combine everything then you must interpret a flag. (very, very messy and very very time consuming.)

| | |
|---|---|
| RTMSG_SENDNAME | - Contains a request for a search on a partial name. |
| RTMAG_PERFORMANCE | - Performance statistics from the OS9 system. (Jim knows about this???) |

Output Messages (System Console to Real-Time)

| | |
|---|---|
| SYSMSG_STARTSORT | - Notifys RT that sortplan records will follow, contains the Run ID. |

NOTE: The Run ID is generated by the system console and passed to the RT in this message.

| | |
|---|---|
| SYSMSG_SORTPLAN | - Contains sort plan record |
| SYSMSG_ENDSORT | - Tells the RT computer that a sort plan is finished loading. |
| SYSMSG_STARTNAME | - Notifys RT that Employee records will follow, |
| SYSMSG_NAME | - Contains Employee record record |
| SYSMSG_ENDNAME | - Tells the RT computer that done sending Employee records. |
| SYSMSG_STOPSORT | - Contains sort plan record |
| SYSMSG_STARTUP | - Places RT into Homing condition |
| SYSMSG_FINISHED | - Finished sort after operator stops machine |

9.1 Input Messages

| Message Parameter | Description |
|---|---|
| RTMSG_HELLO | |
| | This is a message to the system console containing the Machine ID. This will become more important when we have multiple sorters and computers. |
| wParam | wMachineID |
| lParam | Not used |
| data record | Not used |
| RTMSG_JAM | |
| | This is a message to the system console containing Jam information. This information will be placed in the database. |
| wParam | Not used |
| lParam | Not used |
| data record | JAM_REC |
| RTMSG_LETTER | |
| | This is a message to the system console containing letter information. Reject, Code values, Destination, Fed by, Physical Attributes make up the letter record. This information will be placed in the database. |
| wParam | Not used |
| lParam | Not used |
| data record | LETTER_REC |
| RTMSG_TIMELINE | This is a message to the system console |

APPENDIX A-continued

| | |
|---|---|
| | containing Timeline information. Startup, E-Stops, Maintenance, Jams make up the time line for a run. This information will be placed in the database. |
| wParam | Not used |
| lParam | Not used |
| data record | TIMELINE_REC |
| RTMSG_SENDNAME | |
| | This is a message to the system console containing a request for a search on a partial name. This information will be used to return a list of names for the manual feed operator to select from. |
| wParam | Not used |
| lParam | Not used |
| data record | EMPLOYEE_REC |

9.2.Output Messages from Real-time to System console

| Message Parameter | Description |
|---|---|
| SYSMSG_STARTUP | |
| | Tells the RT computer that the operator performed a menu startup. This will bring the machine to the homing state. |
| wParam | Not used |
| lParam | Not used |
| data record | Not used |
| SYSMSG_STARTSORT | |
| | Tells the RT computer that a sort plan is to be loaded. Also lets the RT know what the Run ID should be. |
| wParam | wRunID - Generated by system console |
| lParam | Not used |
| data record | Not used |
| SYSMSG_SORTPLAN | |
| | Contains the sort plan that the RT computer will use to do its stuff. Only one pass will be loaded at a time. |
| wParam | Not used |
| lParam | Not used |
| data record | BIN_REC |
| SYSMSG_ENDSORT | |
| | Tells the RT computer that a sort plan is finished loading. |
| wParam | Number of BIN_REC sent |
| lParam | Not used |
| data record | Not used |
| SYSMSG_STARTNAME | |
| | Notifys RT that Employee records will follow, |
| wParam | Not used |
| lParam | Not used |
| data record | Not used |
| SYSMSG_NAME | |
| | Contains Employee record including the mailstop. |
| wParam | Not used |
| lParam | Not used |
| data record | EMPLOYEE_REC |
| SYSMSG_ENDNAME | |
| | Tells the RT computer that done sending Employee records. |
| wParam | Number of EMPLOYEE_REC sent |
| lParam | Not used |
| data record | Not used |
| SYSMSG_FINISHED | |
| | Tells the RT computer that the operator no longer wants to use the current sort plan. |
| wParam | Not used |
| lParam | Not used |
| data record | Not used |

APPENDIX B

| Present State | Inputs | Next State | Outputs |
|---|---|---|---|
| Any State | MSG_ESTOP | | SST_ESTOPPED to: Motor Supervisors. |
| IDLE | MSG_SYS_START from isrSysStart & | HOMING | SST_GO_Home to: Motor Supervisors. |

APPENDIX B-continued

| Present State | Inputs | Next State | Outputs |
|---|---|---|---|
| | MSG_MENU_STARTUP from SUPV_SYS_CONSOLE | | |
| | MSG_ESTOP;TRUE | ESTOP_ HOMING | |
| HOMING | MSG_HOME_OK;TRUE from: Motor Supervisors | STOPPED | SST_STOPPED to: Motor Supervisors. DisableStart ( ); |
| | MSG_HOME_OK;FALSE from any: Motor Supervisor | IDLE | SST_HOME_FAILED to: SysConsole |
| | MSG_ESTOP;TRUE | ESTOP_ HOMING | |
| ESTOP_ HOMING | MSG_ESTOP;FALSE | IDLE | SST_IDLE to: Motor Supervisors. |
| STOPPED | MSG_SORT_PLAN from: SYS_CONSOLE | READY | SST_READY to: Motor Supervisors EnableStart( ) |
| | MSG_ESTOP;TRUE | ESTOP_ STOPPED | |
| ESTOP_ STOPPED | MSG_ESTOP;FALSE | STOPPED | SST_STOPPED to: Motor Supervisors. |
| READY | MSG_SYS_START from: isrSysStart( ) | REV_UP | SST_REV_UP to: Motor Supervisors |
| | MSG_FINISHED_SORT from: SYS_CONSOLE | STOPPED | SST_STOPPED to: Motor Supervisors. DisableStart( ) |
| | MSG_MAINTENANCE | MAINTENANCE | |
| | MSG_ESTOP | ESTOPPED_ AFT_READY | |
| ESTOPPED_ AFT_READY | MSG_ESTOP;FALSE & MSG_MAIL_IN_SYS;FALSE from all Motor Supervisors | READY | SST_READY to: Motor Supervisors. EnableStart( ); |
| | MSG_ESTOP;FALSE & MSG_MAIL_IN_SYS;TRUE from any Motor Supervisor | STOPPED_ON_ JAM | SST_STOPPED_ON_JAM to: Motor Supervisors. EnableStart( ); |
| REV_UP | MSG_REV_UP_OK;TRUE from: Motor Supervisors | GRINDING | SST_GRINDING to: Motor Supervisors. nWorkingState =GRINDING |
| | MSG_REV_UP_OK;FALSE from any: Motor Supervisor | READY | SST_READY to: Motor Supervisors. |
| | MSG_ESTOP | ESTOPPED_ AFT_READY | |
| GRINDING | MSG_SYS_STOP from: isrSyssStop( ) | PURGING | SST_PURGING to: Motor Supervisors. SST_IS_PURGED to: AF, MF nWorkingState =PURGING BlinkReadyLight( ); |
| | MSG_JAM from: SupvErrJam | STOPPING_ ON_JAM | SST_STOP_ON_JAM to: Motor Supervisors |
| | MSG_ESTOP | ESTOPPED_ AFT_READY | |
| STOPPING_ ON_JAM | MSG_STOP_ON_JAM_OK:T From: Motor Supervisors | STOPPED_ ON_JAM | SST_STOPPED_ON_JAM to: Motor Supervisors. EnableStart( ); |
| | MSG_STOP_ON_JAM_OK:F From any: Motor Supervisor | ESTOPPED_ AFT_READY | MSG_ESTOP to SupvSysState (fake ESTOP!) |
| | MSG_ESTOP | ESTOPPED_ AFT_READY | |
| STOPPED_ ON_JAM | MSG_SYS_START from: isrSysStart( ) | JAM_ RECOVERY | SST_JAM_RECOVERY to: Motor Supervisor. SST_IS_RECOVERED to: MF, AF |
| | MSG_ESTOP | ESTOPPED_ AFT_READY | |
| JAM_ RECOVERY | MSG_RECOVERED_OK from: MF and AF | JAM_ RECOVERY | SST_IS_RECOVERED to: ReadPrint |
| | MSG_RECOVERED_OK from: ReadPrint | JAM_ RECOVERY | SST_IS_RECOVERED to: Inserter |
| | MSG_RECOVERED_OK from: Inserter | JAM_ RECOVERY | SST_IS_RECOVERED to: Stacker |
| | MSG_RECOVERED_OK from: Stacker & nWorkingState =GRINDING | REV_UP | SST_REV_UP to: Motor Supervisors. |

APPENDIX B-continued

| Present State | Inputs | Next State | Outputs |
|---|---|---|---|
| | MSG_RECOVERED_OK from: Stacker & nWorkingState =PURGING | RAMP_DOWN | SST_RAMP_DOWN to: Motor Supervisors. |
| | MSG_ESTOP | ESTOPPED_ AFT_READY | |
| PURGING | MSG_PURGED_OK from: MF and AF | PURGING | SST_IS_PURGED to: ReadPrint |
| | MSG_PURGED_OK from: ReadPrint | PURGING | SST_IS_PURGED to: Inserter |
| | MSG_PURGED_OK from: Inserter | PURGING | SST_IS_PURGED to: Stacker |
| | MSG_PURGED_OK from: Stacker | RAMP_DOWN | SST_RAMP_DOWN to: Motor Supervisors. |
| | MSG_JAM from SupvErrJam | STOPPING_ ON_JAM | SST_STOP_JAM to: Motor Supervisors. |
| | MSG_ESTOP | ESTOPPED_ AFT_READY | |
| RAMP_DOWN | MSG_RAMP_DOWN_OK:T From: Motor Supervisors | READY | SST_READY to: Motor Supervisors. |
| | MSG_RAMP_DOWN_OK:F From any: Motor Supervisor | ESTOPPED_ AFT_READY | |
| | MSG_ESTOP | ESTOPPED_ AFT_READY | |
| MAINTENANCE | Undefined | Undefined | Undefined |

APPENDIX C

| Present State | Inputs | Next State | Outputs |
|---|---|---|---|
| ST_IDLE | SST_GO_HOME | ST_HOMING | Home Cleat Belt |
| | SST_ESTOPPED | ST_IDLE | |
| | SST_GRINDING | ST_WAITING_FOR_Piece | bWaitingForClear = TRUE ThisLetter =NULL LastLetter =NULL CLEAR_MF_FLAGS |
| ST_HOMING | MSG_POLL && bHomed | ST_IDLE | MSG_HOME_OK:TRUE to SysState |
| | MSG_POLL && !bHomed | ST_HOMING | MSG_POLL to ManFeed |
| | SST_ESTOPPED | ST_IDLE | |
| ST_WAITING_ FOR_PIECE | bPurging Any msg triggers | ST_IDLE | |
| | MSG_MAIL_PRESENT | ST_WAITING_TO_START | Trigger Scale |
| | MSG_MAILSTOP | ST_WAITING_FOR_PIECE | Letter->mailstop |
| | SST_STOP_ON_JAM | ST_STOPPED_ON_JAM | Motors weren't moving |
| | SST_ESTOPPED | ST_ESTOPPED | |
| ST_WAITING_ TO_START | MSG_MAILSTOP | ST_WAITING_TO_START | Letter->mailstop flag |
| | MSG_WEIGHT | ST_WAITING_TO_START | Letter->weight flag |
| | Weight && Mailstop && MailPresent && HandAway | ST_WAITING_FOR_CLEAR | MSG_CARRIER_REQUEST to CarrSched nSentNotReceived++ ThisLetter =NULL bWaitingForClear = TRUE |
| | MSG_CANCEL | ST_WAITING_FOR_PIECE | CLEAR_MF_FLAGS |
| | SST_STOP_ON_JAM | ST_STOPPED_ON_JAM | Motors weren't moving |
| | SST_ESTOPPED | ST_ESTOPPED | |
| ST_WAITING_ FOR_CLEAR | MSG_CLEAR && !bPurging | ST_WAITING_FOR_PIECE | bWaitingForClear = FALSE CLEAR_MF_FLAGS |
| | MSG_CLEAR && | ST_IDLE | bWaitingForClear = FALSE |
| | SST_STOP_ON_JAM | ST_STOPPING_ON_JAM | Stop Motors. MSG_POLL to ManFeed bCleatStopped =FALSE |
| | SST_ESTOPPED | ST_ESTOPPED | bWaitingForClear=TRUE bCleatStopped =TRUE |
| ST_STOPPING _ON_JAM | MSG_POLL && !bCleatStopped | ST_STOPPING_ON_JAM | MSG_POLL to ManFeed |
| | MSG_POLL && bCleatStopped | sT_STOPPED_ON_JAM | bCleatStopped =TRUE |

APPENDIX C-continued

| Present State | Inputs | Next State | Outputs |
|---|---|---|---|
| | SST_ESTOPPED | ST_STOPPED_ON_JAM | bCleatStopped =TRUE |
| ST_STOPPED _ON_JAM | SST_JAM_RECOVERY && !bWaitingForClear | ST_JAM_RECOVERY | Cleat Home-Slow |
| | SST_JAM_RECOVERY && !bWaitingForClear | ST_IDLE | |
| | SST_ESTOPPED | ST_STOPPED_ON_JAM | |
| ST_JAM_ RECOVERY | MSG_CLEAR | ST_IDLE | bWaitingForClear=FALSE |
| | SST_ESTOPPED | ST_STOPPED_ON_JAM | bWaitingForClear=TRUE |
| ST_ESTOPPED | SST_STOPPED_ON_JAM && !bWaitingForClear | ST_IDLE | CLEAR_MF_FLAGS |
| | SST_STOPPED_ON_JAM && bWaitingForClear | ST_STOPPED_ON_JAM | |
| | SST_READY | ST_IDLE | CLEAR_MF_FLAGS |

APPENDIX D

| Present State | Inputs | Next State | Outputs |
|---|---|---|---|
| Any | SST_IS_MAIL_IN_SYS no mail in feeder | Same | MSG_MAIL_IN_SYS:TRUE to SupvSysState |
| | SST_IS_MAIL_IN_SYS & there is mail in the feeder | Same | MSG_MAIL_IN_SYS:FALSE to SupvSysState |
| | MSG_INCOMING from Carrier Scheduler | Same | NextCatchupLetter = Incoming letter. nSentNotReceived— |
| | SST_IS_RECOVERED | Same | bJamRecovery =TRUE MSG_POLL to ManFeed |
| | SST_IS_PURGING | Same | bPurging =TRUE MSG_POLL to ManFeed |
| NOTE: No mail in feeder means: CatchupLetter ==NULL AND NextCatchupLetter ==NULL AND nSentNotReceived ==0 | | | |
| ST_STOPPED | SST_REV_UP | ST_REV_UP | Start Catchup Belt bPurging =FALSE bRampedDown =FALSE Clear Letter Ptrs. |
| | SST_ESTOPPED | ST_STOPPED | |
| ST_REV_UP | MSG_UP_TO_SPEED | ST_REV_UP | MSG_REV_UP_OK:TRUE to SysState |
| | SST_GRINDING | ST_WAITING_FOR_PIECE | |
| | SST_RAMP_DOWN | ST_RAMP_DOWN | Start to stop belts bRampedDown =FALSE bJamRecovery =FALSE |
| | SST_ESTOPPED | ST_STOPPED | |
| ST WAITING FOR_PIECE | MSG_POLL && bPurging ==TRUE && no mail coming from cleat area | ST_WAITING_FOR_PIECE | MSG_PURGED_OK:True to SysState bPurging =FALSE |
| | MSG_POLL && bJamRecovery ==TRUE && no mail coming from cleat area | ST_WAITING_TO_START | MSG_RECOVERED OK: TRUE to SysState bJamRecovery =FALSE |
| | MSG_POLL && Mail coming from cleat area && !bJamRecovery && !bPurging | ST_WAITING_FOR_PIECE | MSG_POLL to ManFeed |
| | MSG_POLL && && NextLetter != NULL | ST_WAITING_TO_START | ThisCatchupLetter = NextCatchupLetter NextCatchupLetter =NULL |
| | MSG_INCOMING && NextLetter != NULL | ST_WAITING_TO_START | ThisCatchupLetter = NextCatchupLetter NextCatchupLetter =NULL |
| | SST_RAMP_DOWN | ST_RAMP_DOWN | bJamRecovery =FALSE Stop Catchup belt bRampedDown =FALSE |
| | SST_REV_UP | ST_REV_UP | bJamRecovery =FALSE |

APPENDIX D-continued

| | | | |
|---|---|---|---|
| | | | bPurging =FALSE<br>Clear Letter ptrs.<br>Start Motors |
| | SST_STOP_ON_JAM | ST_STOPPING_ON_JAM | Stop Motors<br>MSG_POLL to ManFeed |
| | SST_ESTOPPED | ST_ESTOPPED | |
| NOTE: No mail coming from cleat area means:<br>CatchupLetter ==NULL AND NextCatchupLetter ==NULL<br>AND MFState ==ST_IDLE | | | |
| ST_WAITING_<br>TO_START | MSG_CATCHUP_ENTER<br>&& !bJamRecovery | ST_WAITING_FOR_CLEAR | ThisCatchupLetter->thickness =read thickness.<br>MSG_INCOMING to ReadPrint<br>Start acceleration. |
| | MSG_CATCHUP_ENTER<br>&& bJamRecovery | ST_WAITING_FOR_PIECE | ThisCatchupLetter->thickness =read thickness.<br>MSG_INCOMING to ReadPrint.<br>MSG_POLL to ManFeed |
| | SST_STOP_ON_JAM | ST_STOPPING_ON_JAM | Stop Motors.<br>MSG_POLL to ManFeed |
| | SST_ESTOPPED | ST_ESTOPPED | |
| ST_WAITING_<br>FOR_CLEAR | SST_PURGING | ST_WAITING_FOR_CLEAR | Stop feeding. |
| | MSG_CATCHUP_CLEAR<br>&& (bPurging \|\|<br>bJamRecovery) | ST_WAITING_FOR_PIECE | MSG_POLL to ManFeed |
| | SST_STOP_ON_JAM | ST_STOPPING_ON_JAM | Stop Motors.<br>MSG_POLL to ManFeed |
| | SST_ESTOPPED | ST_ESTOPPED | |
| ST_STOPPING<br>_ON_JAM | MSG_POLL &&<br>!(bCleatStopped &&<br>bRampedDown) | ST_STOPPING_ON_JAM | MSG_POLL to ManFeed |
| | MSG_POLL &&<br>bCleatStopped &&<br>bRampedDown | ST_STOPPING_ON_JAM | MSG_STOPPED_ON_JAM_OK<br>TRUE to SysState |
| | SST_STOPPED ON_JAM | ST_STOPPED ON_JAM | |
| | SST_ESTOPPED | ST_STOPPED ON_JAM | |
| ST_STOPPED<br>_ON_JAM | SST_JAM_RECOVERY<br>&& NoMail<br>&& bPurging | ST_WAITING_FOR_PIECE | Go to recover speed.<br>bRampedDown =FALSE<br>MSG_POLL to ManFeed |
| | SST_JAM_RECOVERY<br>&& No Mail<br>&& !bPurging | ST_WAITING_FOR_PIECE | Go to recover speed.<br>bRampedDown =FALSE |
| | SST_JAM_RECOVERY<br>&& Mail in feeder | ST_WAITING_TO_START | Go to recover speed. |
| | SST_ESTOPPED | ST_STOPPED_ON_JAM | |
| NOTE: No mail means there aren't any letters waiting to be caught up:<br>CatchupLetter ==NULL && NextCatchupLetter ==NULL. | | | |
| ST_RAMP_<br>DOWN | MSG_POLL &&<br>!bRampedDown | ST_RAMP_DOWN | MSG_POLL to ManFeed |
| | MSG_POLL && Catchup<br>bRamped Down | ST_STOPPED | MSG_RAMP_DOWN_OK:TRUE |
| | SST_READY | ST_STOPPED | |
| | SST_ESTOPPED | ST_STOPPED | |
| ST_ESTOPPED | SST_READY | ST_STOPPED | |
| | SST_STOPPED_ON_JAM | ST_STOPPED_ON_JAM | |

APPENDIX E

| PRESENT<br>STATE | Inputs | Next<br>State | Outputs |
|---|---|---|---|
| ST_IDLE | SST_GO_HOME | ST_IDLE | MSG_HOMED_OK:TRUE |
| | SST_ESTOPPED | ST_IDLE | |
| | SST_GRINDING | ST_WAITING_FOR_PIECE | bWaitingForClear =<br>FALSE<br>ThisLetter =NULL<br>LastLetter =NULL |
| ST_WAITING_<br>FOR_PIECE | bPurging | ST_IDLE | |
| | Any msg triggers | | |
| | MSG_MAIL_PRESENT | ST_WAITING_FOR_CLEAR | MSG_CARRIER_REQUEST<br>to CarrSched<br>nSentNotReceived++ |

-continued

APPENDIX E

| PRESENT STATE | Inputs | Next State | Outputs |
|---|---|---|---|
| | | | ThisLetter =NULL bWaitingForClear = TRUE |
| | SST_STOP_ON_JAM | ST_STOPPED_ON_JAM | Motor's weren't moving |
| | SST_ESTOPPED | ST_ESTOPPED | |
| ST_WAITING_ FOR_CLEAR | MSG_CLEAR && !bPurging | ST_WAITING_FOR_PIECE | bWaitingForClear = FALSE |
| | MSG_CLEAR && bPurging | ST_IDLE | bWaitingForClear = FALSE |
| | SST_STOP_ON_JAM | ST_STOPPING_ON_JAM | Stop Motors. MSG_POLL to ManFeed |
| | SST_ESTOPPED | ST_ESTOPPED | |
| ST_STOPPING _ON_JAM | MSG_POLL && Singulator not stopped. | ST_STOPPING_ON_JAM | MSG_POLL to ManFeed |
| | MSG_POLL && Singulator stopped | ST_STOPPED_ON_JAM | |
| | SST_ESTOPPED | ST_STOPPED_ON_JAM | |
| ST_STOPPED _ON_JAM | SST_JAM_RECOVERY && bWaitingForClear | ST_JAM_RECOVERY | Do Slower Speed Start to finish singulating any previous piece still in singulator. |
| | SST_JAM_RECOVERY && !bWaitingForClear | ST_IDLE | |
| | SST_ESTOPPED | ST_STOPPED_ON_JAM | |
| ST_JAM_ RECOVERY | MSG_CLEAR | ST_IDLE | bWaitingForClear=FALSE |
| | SST_ESTOPPED | ST_STOPPED_ON_JAM | bWaitingForClear=TRUE |
| ST_ESTOPPED | SST_STOPPED_ON_JAM && !bWaitingForClear | ST_IDLE | CLEAR_MF_FLAGS |
| | SST_STOPPED_ON_JAM && bWaitingForClear | ST_STOPPED_ON_JAM | |
| | SST_READY | ST_IDLE | |

APPENDIX F

| Present State | Inputs | Next State | Outputs |
|---|---|---|---|
| ST_WAIT_ ON_ENTER | Leading edge at AutoFeed Catchup Enter | ST_WAIT_ ON_INSIDE | GnAccelDirec, GwCatchupTime |
| ST_WAIT_ ON_INSIDE | (Trailing edge at AutoFeed Catchup Enter) AND (AutoFeed Catchup leaving is blocked) | ST_WAIT_ ON_ACK | isr: count=GwCatchupTime (isr: AF_MOTOR_ACCEL or AF_MOTOR_DECEL) |
| | (Trailing edge at AutoFeed Catchup Enter) AND (AutoFeed Catchup leaving is not blocked) | ST_WAIT_ ON_LEAVING | |
| ST_WAIT_ ON_LEAVING | (Trailing edge at AutoFeed Catchup Leaving) | ST_WAIT_ ON_ACK | count down=GwCatchupTime (isr: AF_MOTOR_ACCEL or AF_MOTOR_DECEL) |

APPENDIX G

| Present State | Inputs | Next State | Outputs |
|---|---|---|---|
| READY | SST_REV_UP from: SupvSysState | REV_UP | Start AF Catchup motor to go to normal speed |
| REV_UP | MSG_AF_CATCHUP_ACK | REV_UP | MSG_REV_UP_OK;T to: SupvSysState |
| | SST_GRINDING | GRINDING | |
| GRINDING | SST_PURGING | PURGING | |
| | SST_STOP_ON_JAM | STOPPING_ ON_JAM | Stop AF Catchup Motor MSG_POLL to SupvAutoFeed |
| PURGING | (SST_IS_PURGED or MSG_POLL) and GpstLetter==NULL and no Mail being Singulated | PURGING | MSG_PURGED_OK;T to: SupvSysState. |

-continued

APPENDIX G

| Present State | Inputs | Next State | Outputs |
|---|---|---|---|
| | (SST_IS_PURGED or MSG_POLL) and (GpstLetter!=NULL or Mail is being singulated) | PURGING | MSG_POLL to: SupvAutoFeed |
| | SST_STOP_ON_JAM | STOPPING_ ON_JAM | Stop AF Catchup Motor MSG_POLL to SupvAutoFeed |
| | SST_RAMP_DOWN | RAMP_DOWN | Stop AF Catchup Motor MSG_POLL to SupvAutoFeed |
| RAMP_DOWN | MSG_POLL & (AF Catchup Motor Moving OR AF Singulator moving) | RAMP_DOWN | MSG_POLL to: SupvAutoFeed |
| | MSG_POLL & AF Catchup Not Moving & AF Singulator not moving | RAMP_DOWN | MSG_RAMP_DOWN_OK;T to: SupvSysState |
| | SST_READY from: SupvSysState | READY | |
| STOPPING_ ON_JAM | MSG_POLL & (AF Catchup Motor Moving OR AF Singulator Moving) | STOPPING_ ON_JAM | MSG_POLL to: SupvInserter |
| | MSG_POLL & AF Catchup Motor Not Moving & Singulator Not Moving | STOPPING_ ON_JAM | MSG_STOP_ON_JAM_OK;T to: SupvSysState |
| | SST_STOPPED_ON_JAM | STOPPED_ ON_JAM | |
| STOPPED_ ON_JAM | SST_JAM_RECOVERY from SupvSysState | JAM_ RECOVERY | Start AF catchup at slow speed. |
| JAM_ REVOVERY | (SST_IS_RECOVERED or MSG_POLL) and GpstLetter==NULL && no mail in singulator | JAM_ RECOVERY | MSG_RECOVERED_OK;T to: SupvSysState. |
| | (SST_IS_RECOVERED or MSG_POLL) and (GpstLetter!=NULL OR there is mail in singulator) | JAM_ RECOVERY | MSG_POLL to: SupvAutoFeed. |
| | SST_REV_UP from SupvSysState | REV_UP | Start AF Catchup Motor to go to normal speed. |
| | SST_RAMP_DOWN from SupvSysState | RAMP_DOWN | Stop AF Catchup Motor. MSG_POLL to SupvAutoFeed. |
| ESTOP_ AFTER_READY | SST_STOPPED, SST_READY | READY | |
| | SST_STOPPED_ON_JAM | STOPPED_ ON_JAM | |
| ANY STATE | ESTOP | ESTOP_AFTER_ READY | |
| | MSG_INCOMMING | SAME | CALCULATE GWCATCHUPTIME |

APPENDIX H

| Present State | Inputs | Next State | Outputs |
|---|---|---|---|
| Any | SST_IS_MAIL_IN_SYS && no mail in the induction line | Same | MSG_MAIL_IN_SYS:TRUE to SupvSysState |
| | SST_IS_MAIL_IN_SYS && There is mail in the induction line | Same | MSG_MAIL_IN_SYS:FALSE to SupvSysState |
| | MSG_INCOMING from Manual Feed | Same | Insert into Ordered List of expected letters |
| | SST_IS_RECOVERED | Same | bJamRecovery =TRUE MSG_POLL to ReadPrint |
| | SST_IS_PURGING | Same | bPurging =TRUE MSG_POLL to ReadPrint |
| | SST_GO_HOME | Same | Trigger Induction belt encoder counter to reload "zero" value. MSG_HOMED_OK to SysState |

-continued

APPENDIX H

| Present State | Inputs | Next State | Outputs |
|---|---|---|---|
| NOTE: No mail in induction line means that the induction order list is empty. | | | |
| ST_STOPPED | SST_ESTOPPED | ST_STOPPED | |
| | SST_REV_UP | ST_REV_UP | Start Induction Belts MSG_POLL to Read Print. |
| ST_REV_UP | MSG_POLL && induction speed !=Stacker speed | ST_REV_UP | MSG_POLL to ReadPrint |
| | MSG_POLL && induction speed ==Stacker speed | ST_REV_UP | MSG_REV_UP_OK:TRUE to SysState |
| | SST_GRINDING | ST_READING | |
| | SST_RAMP_DOWN | ST_RAMP_DOWN | Start to stop belts |
| | SST_ESTOPPED | ST_STOPPED | |
| ST_RAMP_DOWN | MSG_POLL && !bRampedDown | ST_RAMP_DOWN | MSG_POLL to ManFeed |
| | MSG_POLL && Catchup bRampedDown | ST_STOPPED | MSG_RAMP_DOWN_OK:TRUE to SysState |
| | SST_READY | ST_STOPPED | |
| | SST_ESTOPPED | ST_STOPPED | |
| ST_READING | No Mail && bPurging | ST_READING | MSG_PURGED_OK to SysState |
| | SST_REV_UP | ST_REV_UP | Increase Induction belt speed. bJamRecovery = false |
| | SST_STOP_ON_JAM | ST_STOPPING_ON_JAM | MSG_POLL to Read Print, Start stopping induction motors. |
| | SST_ESTOPPED | ST_ESTOPPED | |
| ST_STOPPING_ON_JAM | MSG_POLL && moving | ST_STOPPING_ON_JAM | MSG_POLL to ReadPrint |
| | MSG_POLL && Cleat !moving | ST_STOPPED_ON_JAM | MSG_STOP_ON_JAM_OK to SysState |
| | SST_ESTOPPED | ST_STOPPED_ON_JAM | |
| ST_STOPPED_ON_JAM | SST_JAM_RECOVERY | ST_READING | Start Induction belts at jam recovery speed. |
| | SST_ESTOPPED | ST_STOPPED_ON_JAM | |
| ST_ESTOPPED | SST_STOPPED_ON_JAM | ST_STOPPED_ON_JAM | |
| | SST_READY | ST_STOPPED | |

APPENDIX I

| Present State | Inputs | Next State | Outputs |
|---|---|---|---|
| ST_WAIT_ON_ENTER | leading edge at Ins Catchup Enter | ST_WAIT_ON_ | GnAccelDirec, GwCatchupTime ON_INSIDE |
| ST_WAIT_ON_INSIDE | (trailing edge at Ins Catchup Enter) AND (Ins Catchup Leaving is blocked) | ST_WAIT_ON_ACK | isr: count=GwCatchupTime (isr: INS_MOTOR_ACCEL or INS_MOTOR_DECEL) |
| | (trailing edge at Ins Catchup Enter) AND (Ins Catchup Leaving is not blocked) | ST_WAIT_ON_LEAVING | |
| ST_WAIT_ON_LEAVING | trailing edge at Ins Catchup Leaving | ST_WAIT_ON_ACK | count down=GwCatchupTime (isr: INS_MOTOR_ACCEL or INS_MOTOR_DECEL) |
| ST_WAIT_ON_ACK | Motor Ack | ST_WAIT_ON_ENTER | MSG_INCOMMING TO SUPV_STACKER |

APPENDIX J

| Present State | Inputs | Next State | Outputs |
|---|---|---|---|
| IDLE | SST_GO_HOME from: SupvSysState | READY | MSG_HOME_OK;T to: SupvSysState |
| READY | SST_REV_UP from: SupvSysState | REV_UP | inserter INS_MOTOR_NORMAL |
| REV_UP | MSG_INS_MOTOR_ACK from: isrInsMotorAck | REV_UP | MSG_ REV_UP_OK;T to: SupvSysState |
| | SST_GRINDING | GRINDING | |
| | SST_RAMP_DOWN | RAMP_DOWN | inserter INS_MOTOR_STOP |
| GRINDING | SST_PURGING | PURGING | |
| | SST_STOP_ON_JAM | STOPPING_ ON_JAM | inserter INS_MOTOR_STOP |
| PURGING | (SST_IS_PURGED or MSG_POLL) and (empty queue and GnInsState =WAIT_ON_ENTER) | PURGING | MSG_PURGED_OK;T to: SupvSysState. |
| | (SST_IS_PURGED or MSG_POLL) and not empty queue | PURGING | MSG_POLL to: SupvInserter |
| | SST_RAMP_DOWN | RAMP_DOWN | inserter INS_MOTOR_STOP |
| RAMP_DOWN | MSG_INS_MOTOR_ACK | RAMP_DOWN | MSG_RAMP_DOWN_OK;T to: SupvSysState |
| | SST_READY from: SupvSysState | READY | |
| ANY STATE | ESTOP | ESTOP_AFTER_ READY | |
| | MSG_INCOMMING | SAME | CALCULATE GwCATCHUPTIME |
| STOPPING_ ON_JAM | MSG_INS_MOTOR_ACK | STOPPING_ ON_JAM | MSG_STOP_ON_JAM_OK;T to: SupvSysState |
| | SST_STOPPED_ON_JAM | STOPPED_ ON_JAM | |
| STOPPED_ ON_JAM | SST_JAM_RECOVERY from SupvSysState | JAM_ RECOVERY | inserter INS_MOTOR_SLOW |
| JAM_ RECOVERY | (SST_IS_RECOVERED or MSG_POLL) and (empty queue and GnInsState =WAIT_ON_ENTER) | JAM_ RECOVERY | MSG_RECOVERED_OK;T to: SupvSysState. |
| | (SST_IS_RECOVERED or MSG_POLL) and not empty queue | JAM_ RECOVERY | MSG_POLL to: SupvInserter. |
| | SST_REV_UP from SupvSysState | REV_UP | inserter INS_MOTOR_NORMAL |
| | SST_RAMP_DOWN from SupvSysState | RAMP_DOWN | inserter INS_MOTOR_STOP MSG_POLL to SupvInserter |
| ESTOP_ AFTER_READY | SST_IDLE | IDLE | |
| | SST_STOPPED, SST_READY | READY | |
| | SST_STOPPED_ON_JAM | STOPPED_ ON_JAM | |

APPENDIX K

| Present State | Inputs | Next State | Outputs |
|---|---|---|---|
| Any state | ESTOP | ESTOP_ AFTER_READY | |
| IDLE | SST_GO_HOME from: SupvSysState | HOMING | stacker STK_MOTOR_SLOW |
| HOMING | MSG_CHAIN_HOME from: isrChainHome( ) | HOMING | MSG_HOME_OK;T to: SupvSysState |
| | | | stacker STK_MOTOR_STOP |
| | SST_GO_HOME from: SupvSysState & bHome | HOMING | MSG_HOME_OK;T to: SupvSysState |
| | SST_STOPPED from: SupvSysState | READY | |
| READY | SST_REV_UP from: SupvSysState | REV_UP | stacker STK_MOTOR_FAST |
| REV_UP | MSG_STK_MOTOR_ACK | REV_UP | MSG_ REV_UP_OK;T to: SupvSysState |
| | SST_GRINDING | GRINDING | |
| GRINDING | SST_PURGING | PURGING | |
| | SST_STOP_ON_JAM | STOPPING_ ON_JAM | stacker STK_MOTOR_STOP MSG_POLL to SupvStacker. |

-continued

APPENDIX K

| Present State | Inputs | Next State | Outputs |
|---|---|---|---|
| PURGING | (SST_IS PURGED or MSG_POLL) and GpstStackEventTop==NULL | PURGING | MSG_PURGED OK;T to: SupvSysState. |
| | (SST_IS_PURGED or MSG_POLL) and GpstStackEventTop!=NULL | PURGING | MSG_STK_POLL to: SupvStacker |
| | SST_RAMP_DOWN | RAMP_DOWN | stacker STK_MOTOR_STOP MSG_POLL to SupvStacker. |
| RAMP_DOWN | MSG_POLL & motor moving | RAMP_DOWN | MSG_POLL to: SupvStacker |
| | MSG_POLL & motor not moving | RAMP_DOWN | MSG_RAMP_DOWN_OK;T to: SupvSysState |
| | SST_READY from: SupvSysState | READY | |
| STOPPING_ ON_JAM | MSG_POLL & motor moving | STOPPING_ ON_JAM | MSG_POLL to: SupvStacker |
| | MSG_POLL & motor not moving | STOPPING_ ON_JAM | MSG_STOP_ON_JAM_OK;T to: SupvSysState |
| | SST_STOPPED_ON_JAM | STOPPED_ ON_JAM | |
| STOPPED_ ON_JAM | SST_JAM_RECOVERY from SupvSysState | JAM_ RECOVERY | stacker STK_MOTOR_SLOW |
| JAM_ RECOVERY | (SST_IS_PURGED or MSG_POLL) and GpstStackEventTop==NULL | JAM_ RECOVERY | MSG_PURGED_OK to SupvSysState |
| | (SST_IS_PURGED or MSG_POLL) and GpstStackEvenTop!=NULL | JAM_ RECOVERY | MSG_POLL to SupvStacker |
| | SST_REV_UP from SupvSysState | REV_UP | stacker STK_MOTOR_FAST |
| | SST_RAMP_DOWN from SupvSysState | RAMP_DOWN | stacker STK_MOTOR_STOP MSG_POLL to SupvStacker. |
| STOP_ AFTER_READY | SST_IDLE | IDLE | |
| | SST_STOPPED, SST_READY | READY | |
| | SST_STOPPED_ON_JAM | STOPPED_ ON_JAM | |

APPENDIX L

| Present State | Inputs | Next State | Outputs |
|---|---|---|---|
| Any state | ESTOP | ESTOP_ AFTER_READY | |
| | MSG_INCOMING | — | Put the letter at the head of the sensor line |
| EADY GRINDING | SST_GRINDING | GRINDING | |
| | SST_READY | READY | |
| | MSG_JAM from any isr. | JAM_ RECOVERY | MSG_JAM to: SupvSysState MSG_KILL_LETTER to: Motor Supervisors MSG_JAM to: SupvSysConsole |
| JAM_ RECOVERY | SST_GRINDING | GRINDING | |
| | SST_READY | READY | |
| | MSG_JAM from any isr. | JAM_ RECOVERY | MSG_KILL_LETTER to: Motor Supervisors |
| ESTOP AFTER_READY_ | SST_JAM_RECOVERY | JAM_ RECOVERY | |
| | SST_STOPPED,SST_READY, SST_IDLE | READY | |

APPENDIX M

```
switch (wMsg) {
    case MSC_INIT:
        start up the counter timer.
        break;
    case MSC_CARRIER_REQUEST
        *-          Find out which carrier is next available: The
```

-continued

APPENDIX M

```
                wSource ID denotes who wants a carrier, (the next
                carrier is different for each of the feed
                stations) This done by finding the carrier that
                is closest to the starting line 155
wNextCarrier =GetNexCarrier (wSourceID) ;
*-              BEGIN CRITICAL SECTION: Disable all interrupts -*
*-              check to see whether it is too close.
-               IF ((absolute position now - next carrier time) <
                MAX_SCHEDULE_TIME) THEN
                        get the next carrier
                END
DO
                IF (carrier is taken) THEN
                        increment the carrier list index
                END
WHILE carrier is taken
-               GnFeedNext =carrier number!!!
-               carrier list [this carrier] is taken, this letter;
*-              END CRITICAL SECTION Enable Interrupts-*
*-              send a message to the wSourceID MSG_INCOMMING
break; *- MSG_CARRIER_REQUEST -*
```

What is claimed is:

1. A method of processing pieces of internal mail received from an internal source in a system including a stacker module having a number of carriers and bins, a plurality of serially connected induction transfer modules, including a feeder module, that are positioned to transport the pieces of internal mail from the feeder module to the stacker module, the method comprising the steps of:

(a) monitoring the position of each carrier;

(b) pre-selecting an empty carrier;

(c) feeding a piece of internal mail from the feeder module to another induction transfer module at a desired time based on the position of the pre-selected carrier;

(d) tracking the position of the piece of internal mail through the induction transfer modules;

(e) obtaining address information from the piece of internal mail, wherein said address information includes a mail stop;

(f) selecting a bin for the piece of internal mail based on said address information, the selected bin corresponding to a mail stop;

(g) transferring the piece of internal mail from a last induction transfer module to the pre-selected carrier;

(h) diverting the piece of internal mail from the pre-selected carrier to the selected bin;

(i) monitoring the thickness of each piece of internal mail diverted to the selected bin; and (j) determining when the selected bin needs to be replaced based on the monitoring of the thickness.

2. A method according to claim 1, further comprising the step of:

adjusting the position of piece of internal mail within an induction transfer module based on the position of the selected carrier.

3. A method according to claim 2, wherein the system further includes a series of sensor pairs located amongst the plurality of induction transfer modules, and said method further comprises the steps of:

monitoring the piece of internal mail arriving at and leaving each of the sensor pairs; and detecting a position error in response to another piece of internal mail arriving at a sensor pair before the piece of internal mail leaves the sensor pair.

4. A method according to claim 1, wherein said address information further includes an addressee's name.

5. A method according to claim 1, wherein at least some of the pieces of internal mail are interoffice mail envelopes including a region in which an addressee's name may be written and a region in which a mail stop associated with the addressee's name may be written.

6. A method according to claim 5, wherein said region in which an addressee's name may be written includes a plurality of boxes in which single characters of the addressee's name may be written.

7. A method according to claim 5, wherein said region in which a mail stop may be written includes a plurality of boxes in which single characters of the mail stop may be written.

8. A method of processing pieces of incoming mail received from an external source in a system including a stacker module having a number of carriers and bins, a plurality of serially connected induction transfer modules, including a feeder module, that are positioned to transport the pieces of incoming mail from the feeder module to the stacker module, the method comprising the steps of:

(a) monitoring the position of each carrier;

(b) pre-selecting an empty carrier;

(c) feeding a piece of incoming mail from the feeder module to another induction transfer module at a desired time based on the position of the pre-selected carrier;

(d) tracking the position of the piece of incoming mail through the induction transfer modules;

(e) obtaining address information from the piece of incoming mail, wherein said address information includes an addressee's name;

(f) selecting a bin for the piece of incoming mail based on said address information, the selected bin corresponding to a mail stop;

(g) transferring the piece of mail from a last induction transfer module to the pre-selected carrier; and (h) diverting the piece of incoming mail from the pre-selected carrier to the selected bin.

9. A method according to claim 8, further including the steps of:

monitoring the thickness of each piece of incoming mail diverted to the selected bin; and determining when the selected bin needs to be replaced based on the monitoring of the thickness.

10. A method according to claim 8, further comprising the step of:

adjusting the position of piece of incoming mail within an induction transfer module based on the position of the selected carrier.

11. A method according to claim 10, wherein the system further includes a series of sensor pairs located amongst the plurality of induction transfer modules, and said method further comprises the steps of:

monitoring the piece of incoming mail arriving at and leaving each of the sensor pairs; and detecting a position error in response to another piece of incoming mail arriving at a sensor pair before the piece of incoming mail leaves the sensor pair.

12. A method according to claim 8, wherein said address information further includes a mail stop.

13. A modular mail processing control system for controlling the flow of mail through a series of induction transfer modules to a stacker/transport module that includes a number of carriers and bins, said system comprising:

feeder means, located in one of the induction transfer modules, for injecting a piece of mail into another induction transfer module at a desired time based on a pre-selected carrier being at a given position, and for identifying the piece of mail;

encoder means, located in one of the induction transfer modules, for obtaining address information from the piece of mail and for identifying a bin for the piece of mail, wherein said address information includes a mail stop, and the bins correspond to mail stops;

tracking means, located in each of the induction transfer modules, for tracking the position of the piece of mail as it moves through the induction transfer modules, and in response to a position error stopping the series of induction transfer modules, storing the identification of at least the piece of mail involved in the position error and storing the position of the induction transfer modules and the stacker/transport module;

inserter means, located in one of the induction transfer modules for inserting the piece of mail into the pre-selected carrier when the pre-selected carrier arrives at a desired location; and means for diverting the piece of mail from the carrier to the identified bin.

14. A modular mail processing control system according to claim 13, wherein the tracking means includes:

a series of sensor pairs located amongst the induction transfer modules for sensing the presence of the pieces of mail;

means for identifying the piece of mail arriving at and leaving each of the sensor pairs; and means for detecting a position error in response to another piece of mail arriving at a sensor pair before the piece of mail leaves the sensor pair.

15. A modular mail processing control system according to claim 13, wherein the encoder means includes:

an optical character reader;

means for identifying the bin in accordance with a predetermined sort plan; and means for verifying the obtained address information.

16. A modular mail processing control system according to claim 13, further comprising:

means for storing a plurality of sort plans;

means for selecting a sort plan; and wherein the encoder means includes:

an optical character reader;

means for identifying the bin in accordance with said selected sort plan; and means for verifying said obtained address information.

17. A modular mail processing control system according to claim 16, wherein said address information further includes an addressee's name, and wherein said means for verifying said obtained address information verifies that the obtained address is correct based upon a correlation of the addressee's name with the mail stop of the obtained address.

18. A modular mail processing control system according to claim 13, wherein at least some of the pieces of mail are pieces of internal mail received from an internal source.

19. A modular mail processing control system according to claim 13, wherein at least some of the pieces of mail are pieces of incoming mail received from an external source.

20. A modular mail processing control system according to claim 13, wherein at least some of said pieces of internal mail are interoffice mail envelopes including a region in which an addressee's name may be written and a region in which a mail stop associated with the addressee's name may be written.

21. A modular mail processing control system according to claim 20, wherein said region in which an addressee's name may be written includes a plurality of boxes in which single characters of the addressee's name may be written.

22. A modular mail processing control system according to claim 20, wherein said region in which a mail stop may be written includes a plurality of boxes in which single characters of the mail stop may be written.

* * * * *